US010434773B2

(12) United States Patent
Sameshima

(10) Patent No.: US 10,434,773 B2
(45) Date of Patent: Oct. 8, 2019

(54) INK JET DRIVING APPARATUS AND INK JET DRIVING METHOD

(71) Applicant: KONICA MINOLTA, INC., Chiyoda-ku, Tokyo (JP)

(72) Inventor: Kouichi Sameshima, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/073,596

(22) PCT Filed: Jan. 11, 2017

(86) PCT No.: PCT/JP2017/000622
§ 371 (c)(1),
(2) Date: Jul. 27, 2018

(87) PCT Pub. No.: WO2017/130695
PCT Pub. Date: Aug. 3, 2017

(65) Prior Publication Data

US 2019/0030893 A1 Jan. 31, 2019

(30) Foreign Application Priority Data

Jan. 29, 2016 (JP) ..... 2016-015245

(51) Int. Cl.
*B41J 2/14* (2006.01)
*B41J 2/01* (2006.01)
(Continued)

(52) U.S. Cl.
CPC ..... *B41J 2/14233* (2013.01); *B41J 2/01* (2013.01); *B41J 2/14* (2013.01); *B41J 2/165* (2013.01);
(Continued)

(58) Field of Classification Search
CPC ..... B41J 2/14233; B41J 2/01; B41J 2/1623; B41J 2/165; B41J 2/18
See application file for complete search history.

(56) References Cited

U.S. PATENT DOCUMENTS

2003/0058307 A1 3/2003 Eguchi et al.
2005/0248627 A1* 11/2005 Ito ..... B41J 2/14209 347/71
(Continued)

FOREIGN PATENT DOCUMENTS

EP 2006111 A2 12/2008
JP 2004262237 A 9/2004
(Continued)

OTHER PUBLICATIONS

Extended European Search Report corresponding to Application No. 17743926.2-1019/3409474 PCT/JP2017000622; dated Jan. 8, 2019.
(Continued)

*Primary Examiner* — Lamson D Nguyen
(74) *Attorney, Agent, or Firm* — Cantor Colburn LLP

(57) ABSTRACT

When a diameter of a hole at an exit of a nozzle is expressed as D (μm) and a distance between a position in a circulation flow path part on a side thereof closest to the exit and the exit is expressed as N (μm) in an ink jet driving apparatus, N≤3.47D is satisfied. During non-ejection, a driving control unit generates a driving signal for withdrawing ink from the exit of the nozzle to a side of a pressure chamber through a distance of 0.16N or more and 0.555D or less, and for causing the ink meniscus to oscillate, and applies the driving signal to a driving element.

15 Claims, 17 Drawing Sheets

(51) Int. Cl.

| | |
|---|---|
| ***B41J 2/165*** | (2006.01) |
| ***B41J 2/18*** | (2006.01) |
| ***B41J 2/16*** | (2006.01) |

(52) U.S. Cl.

CPC ..... *B41J 2/1623* (2013.01); *B41J 2/18* (2013.01); *B41J 2/1628* (2013.01); *B41J 2/1629* (2013.01); *B41J 2002/14491* (2013.01); *B41J 2202/11* (2013.01); *B41J 2202/12* (2013.01)

(56) References Cited

U.S. PATENT DOCUMENTS

| | | | | |
|---|---|---|---|---|
| 2014/0098160 | A1 | 4/2014 | Hong et al. | |
| 2015/0115202 | A1* | 4/2015 | Kagata ..... | C09D 11/322 252/301.36 |

FOREIGN PATENT DOCUMENTS

| | | | |
|---|---|---|---|
| JP | 2011051214 | A | 3/2011 |
| JP | 2011520671 | A | 7/2011 |
| JP | 2013129089 | A | 7/2013 |
| JP | 2014054844 | A | 3/2014 |
| WO | 2010044775 | A1 | 4/2010 |

OTHER PUBLICATIONS

International Search Report corresponding to Application No. PCT/JP2017/000622; dated Mar. 14, 2017.
IPRP and Written Opinion of corresponding Application No. PCT/JP2017/000622; dated Jul. 31, 2018.

* cited by examiner

DRIVING SIGNAL (WITH SHAKING)

| | CIRCULATION AMOUNT (AS COMPARED WITH EJECTION AMOUNT) | SHAKING DRIVING POTENTIAL (×31V) |
|---|---|---|
| a1 | 1 | 0. 3 |
| a2 | 0. 025 | 0. 3 |
| a3 | 0. 01 | 0. 3 |
| a4 | 1 | 0 (WITHOUT SHAKING) |
| a5 | 0 (WITHOUT CIRCULATION) | 0. 3 |
| a6 | 0 (WITHOUT CIRCULATION) | 0 (WITHOUT SHAKING) |

| | CIRCULATION AMOUNT (AS COMPARED WITH EJECTION AMOUNT) | SHAKING DRIVING POTENTIAL (×31V) |
|---|---|---|
| b1 | 1 | 0. 3 |
| b2 | 0. 025 | 0. 3 |
| b3 | 0. 025 | 0. 2 |
| b4 | 0. 025 | 0. 1 |
| b5 | 1 | 0. 05 |
| b6 | 1 | 0 (WITHOUT SHAKING) |
| b7 | 0. 025 | 0. 05 |

| | | CIRCULATION AMOUNT (AS COMPARED WITH EJECTION AMOUNT) | SHAKING DRIVING POTENTIAL (×31V) |
|---|---|---|---|
| c1 | —●— | 1 | 0. 3 |
| c2 | - - ●- - | 0. 025 | 0. 3 |
| c3 | ·····●····· | 0. 01 | 0. 3 |
| c4 | —●- - | 0. 0025 | 0. 3 |
| c5 | ✕ | 0 (WITHOUT CIRCULATION) | 0. 3 |

INK JET DRIVING APPARATUS AND INK JET DRIVING METHOD

CROSS REFERENCE TO RELATED APPLICATIONS

This is the U.S. national stage of application No. PCT/JP2017/000622, filed on Jan. 11, 2017. Priority under 35 U.S.C. § 119(a) and 35 U.S.C. § 365(b) is claimed from Japanese Application No. 2016-015245, filed on Jan. 29, 2016, the disclosures all of which are also incorporated herein by reference.

TECHNICAL FIELD

The present invention relates to an ink jet driving apparatus which ejects ink, such as an ink jet head and an ink jet printer, and an ink jet driving method.

BACKGROUND ART

Conventionally, there has been known an ink jet head having a plurality of channels from which liquid ink is ejected. By controlling the ejection of ink from each channel while moving the ink jet head relative to a recording medium such as a sheet of paper or cloth, a two-dimensional image is formed on the recording medium.

The ejection of ink is performable, for example, by using a pressure actuator (such as a piezoelectric, electrostatic, or thermal deformation actuator), or by thermally forming a bubble in ink in a tube. Among such actuators, the piezoelectric actuator is advantageous over the others for its large output, modulability, high responsiveness, adaptability to any ink, etc., and has been widely used in recent years. In particular, to achieve a compact, low-cost, high-resolution (achievable with small ink droplets) printer, it is suitable to adopt an ink jet head that uses a thin-film piezoelectric element (a piezoelectric thin film). In such a piezoelectric element, a perovskite-type metal oxide, such as barium titanate ($BaTiO_3$) or lead zirconate titanate ($Pb(Zr, Ti) O_3$), is widely used.

Now, in an ink jet head, a non-ejection state, in which no ink is ejected, lasts long after ink is ejected from a nozzle, ink forming a meniscus (the interface between the ink and air, also referred to as an ink meniscus) in the nozzle becomes dry, and thus the viscosity of the ink increases. The increased viscosity of the ink prevents a smooth ink ejection through the nozzle, and thus degrades ink ejection properties (for example, ejection speed). Accordingly, it is necessary to take measures to moderate the degradation of the ink ejection properties.

In this regard, according to Patent Document 1 listed below, for example, during a non-ejection time, during which no ink is ejected, a non-ejection pulse, which does not cause ink droplets to be ejected from a nozzle, is applied to an actuator to thereby give oscillation to a meniscus, whereby the ink forming the meniscus is prevented from becoming dry. Further, according to Patent Document 2 listed below, for example, in a configuration where a driving pulse is applied by means of an actuator to a fluid pump chamber to cause droplets of a fluid (ink, for example) to be ejected from a nozzle, a circulation flow path part is disposed very close to the nozzle such that ink left in the nozzle without being ejected therefrom circulates via the circulation flow path part, in an attempt to prevent accumulation, in the nozzle, of substances that would hinder ink ejection. Patent Document 1 also discloses a configuration in which a circulation flow path part is disposed diverging from a flow path of ink from a pressure chamber to a nozzle such that the ink is caused to circulate via the circulation flow path part.

CITATION LIST

Patent Documents

Patent Document 1: Japanese Patent Application Publication No. 2011-51214 (see claim 1, paragraphs [0012], [0022], and [0083] to [0092], FIG. 3, etc.)

Patent document 2: Japanese Patent Application Publication (Translation of PCT Application) No. 2011-520671 (see claim 1, paragraphs [0015] and [0046], FIG. 2, etc.)

SUMMARY OF INVENTION

Technical Problem

However, Patent Document 1 does not at all mention anything about the shape of the nozzle (the size of the hole of the nozzle, for example) or the position of the circulation flow path part with respect to the nozzle (the distance between the exit of the nozzle and the circulation flow path part), or does not take into consideration the shape of the nozzle and the position of the circulation flow path part in specifying an ink withdrawal amount by which ink is withdrawn when the meniscus is caused to oscillate. Thus, when ink has failed to be prevented from becoming dry and thus has become more viscous near an exit of the nozzle, the possibility is reduced of successfully guiding the ink with the increased viscosity into the circulation flow path part to remove the ink from inside the nozzle, and thus there is a risk that the ink ejection properties (such as the ejection speed) will be degraded due to the ink.

In Patent Document 2, the meniscus is not caused to oscillate during the non-ejection time, and therefore, in the first place, it is impossible to prevent the ink near the exit of the nozzle from becoming dry and more viscous. Thus, if ink becomes dry and more viscous at the exit of the nozzle, even with a circulation flow path part disposed very close to the nozzle, it becomes difficult to guide the ink into the circulation flow path part, and, as in the case of Patent Document 1, there is a risk that the ejection properties will be degraded due to the ink.

The present invention has been made to solve the above-described problem, and aims at providing an ink jet driving apparatus and an ink jet driving method capable of avoiding the degradation of the ejection properties by appropriately setting the ink withdrawal amount by taking into consideration the shape of the nozzle and the position of the circulation flow path part to thereby increase the possibility that, even in a case where the ink has become more viscous near the exit of the nozzle, the ink with the increased viscosity will be successfully removed from inside the nozzle.

Solution to Problem

According to an aspect of the present invention, an ink jet driving apparatus includes a head substrate which includes a nozzle through which ink is ejected, a pressure chamber which communicates with the nozzle and in which the ink is stored, and a circulation flow path part which is disposed diverging from a flow path of the ink flowing toward the nozzle and which forms a flow path for circulating ink discharged from the pressure chamber, a driving element which is supported on the head substrate, and which causes ink inside the pressure chamber to be ejected through the nozzle during an ejection time and causes an ink meniscus inside the nozzle to oscillate during a non-ejection time, and a drive controller which controls the driving element. Here, when a diameter of a hole at an exit of the nozzle is represented by D (μm), the exit being a portion of the nozzle that is farthest from the pressure chamber, and a distance, in a direction perpendicular to a surface including the hole at the exit, between the exit and a position in the circulation flow path part that is nearest the exit is represented by N (μm), $N \leq 3.47D$ is satisfied. The drive controller generates a driving signal for withdrawing ink from the exit of the nozzle toward the pressure chamber, to a position at a distance equal to or more than 0.16N but equal to or less than 0.555D from the exit, and for causing the ink meniscus to oscillate, and applies the driving signal to the driving element.

According to another aspect of the present invention, an ink jet driving method is one for driving an ink jet driving apparatus, the ink jet driving apparatus including a head substrate including a nozzle through which ink is ejected, a pressure chamber which communicates with the nozzle and in which the ink is stored, and a circulation flow path part which diverges from a flow path of the ink flowing toward the nozzle and which forms a flow path for circulating ink discharged from the pressure chamber, a driving element which is supported on the head substrate, and which causes ink inside the pressure chamber to be ejected through the nozzle during an ejection time and causes an ink meniscus inside the nozzle to oscillate during a non-ejection time, $N \leq 3.47D$ being satisfied when a diameter of a hole at an exit of the nozzle is represented by D (μm), the exit being a portion of the nozzle that is farthest from the pressure chamber, and a distance, in a direction perpendicular to a surface including the hole at the exit, between the exit and a position in the circulation flow path part that is nearest the exit is represented by N (μm). Here, the driving method includes circulating ink via the circulation flow path part by withdrawing the ink, by means of the driving element, from the exit of the nozzle toward the pressure chamber, to a position at a distance equal to or more than 0.16N but equal to or less than 0.555D from the exit, causing the ink meniscus to oscillate, and guiding at least part of the withdrawn ink into the circulation flow path part.

Advantageous Effects of Invention

As described above, by appropriately setting the ink withdrawal amount by taking into consideration the shape of the nozzle and the position of the circulation flow path part, even in a case where ink has failed to be prevented from becoming dry and thus has become more viscous near the exit of the nozzle, it is possible to increase the possibility of successfully removing the ink with the increased viscosity from inside the nozzle, even though by a small amount, and avoiding the degradation of the ejection properties attributable to the ink.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DESCRIPTION OF EMBODIMENTS

Hereinafter, one or more embodiments of the present invention will be described with reference to the drawings. However, the scope of the invention is not limited to the disclosed embodiments.

An embodiment of the present invention will be described below with reference to the accompanying drawings. Herein, when a numerical value range is indicated as A to B, the lower limit value A and the upper limit value B are both included in the numerical value range.

The following description deals with an embodiment, as an example, that employs a one-pass drawing method which draws images with a configuration using a line head (only by conveyance of a recording medium), but alternatively, another drawing method, such as a method using a scanning method or a drum method, may be adopted.

In the following description, a conveyance direction of a recording medium K is a front-back direction, a direction orthogonal to the conveyance direction on a conveying surface of the recording medium K is a left-right direction, and a direction perpendicular to the front-back direction and the left-right direction is an up-down direction.

[Overview of Ink Jet Printer]

Figure 1:
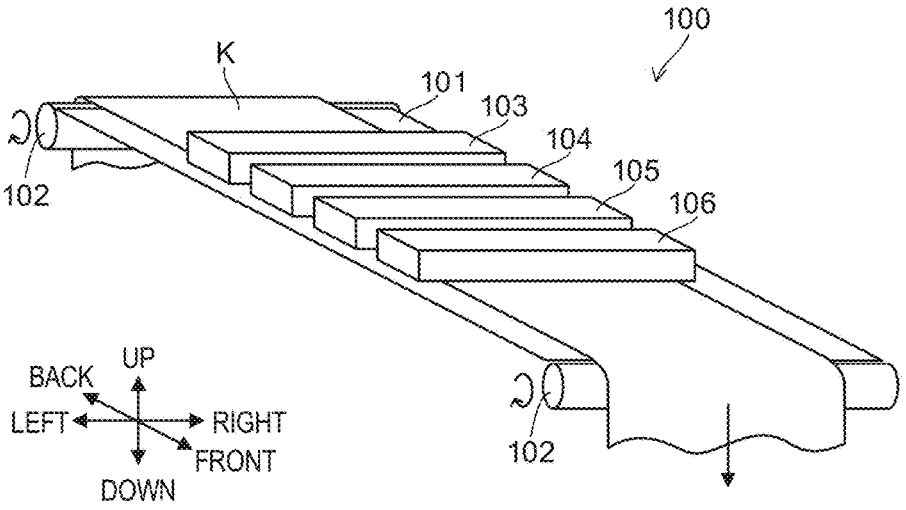
FIG. 1 is a perspective view illustrating a schematic configuration of an ink jet printer according to an embodiment of the present invention.

FIG. 1 is a perspective view illustrating a schematic configuration of an ink jet printer. An ink jet printer 100 includes a platen 101, a conveyance roller 102, line heads 103, 104, 105, and 106, a circulation mechanism 107 (see FIG. 7), and so on. Details of the circulation mechanism 107 will be described later.

The platen 101 supports a recording medium K on its upper surface, and conveys the recording medium K in a conveyance direction (the front-back direction) when the conveyance roller 102 is driven.

The line heads 103 to 106 are each arranged to be elongated in a width direction of the recording medium K (the left-right direction) orthogonal to the conveyance direction of the recording medium K (the front-back direction), and are arranged parallel to each other from upstream side to downstream side in the conveyance direction. The line heads 103 to 106 each have disposed inside thereof at least one later-described ink jet head 1 (see FIG. 2 and so on), and eject ink with colors such as cyan (C), magenta (M), yellow (Y), and black (K), toward the recording medium K.

[Schematic Configuration of Ink Jet Head]

Figure 2:
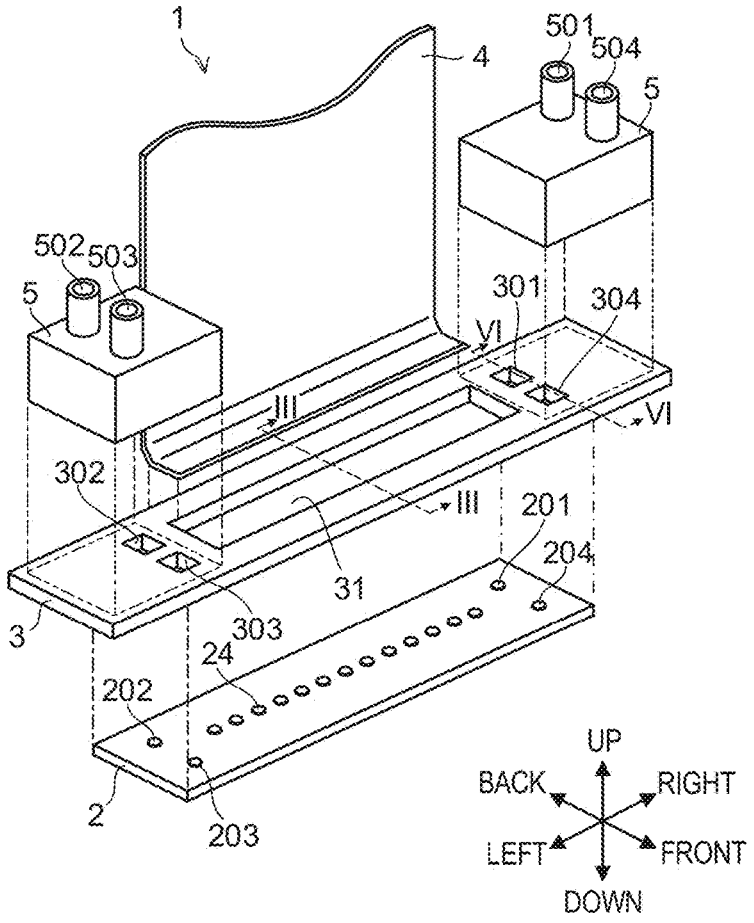
FIG. 2 is an exploded perspective view of an ink jet head incorporated in the ink jet printer.
Figure 3:
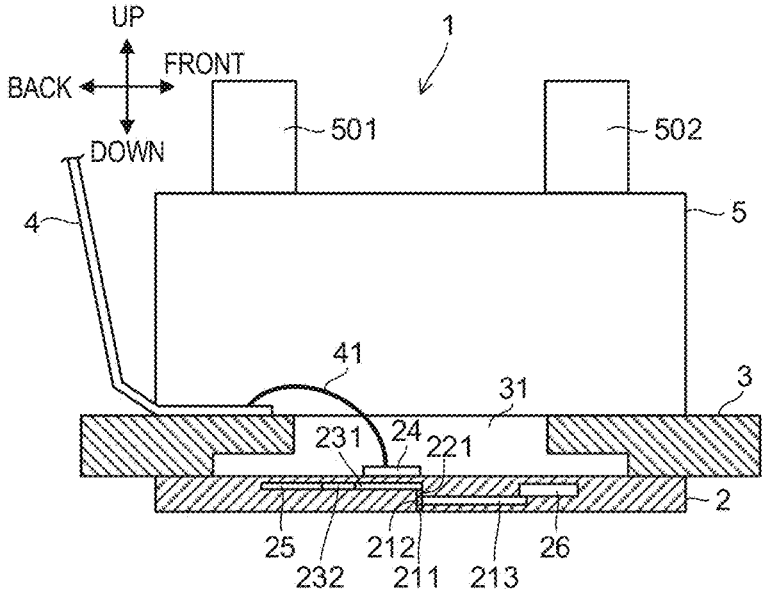
FIG. 3 is a sectional view of the ink jet head, taken along line (III)-(III) in FIG. 2.

FIG. 2 is an exploded perspective view of the ink jet head 1, and FIG. 3 is a sectional view of the ink jet head 1 taken along line (III)-(III) in FIG. 2. The ink jet head 1 includes a head chip 2 (a head substrate), a holding plate 3, a connection member 4, ink flow path members 5, and so on.

The head chip 2 is composed of a plurality of substrates laid one on another, and in a lowermost layer of the head chip 2, there is disposed a nozzle 211 through which ink is ejected. The nozzle 211 communicates with a pressure chamber 231 in which ink is stored. On an upper surface of the head chip 2, a piezoelectric element 24 is disposed as a driving element. Details of the piezoelectric element 24 will be described later. As a result of displacement of the piezoelectric element 24, pressure is applied to the ink in the pressure chamber 231 inside the head chip 2, and the ink is ejected through the nozzle 211 as an ink droplet.

The holding plate 3 is bonded with an adhesive to the upper surface of the head chip 2 to retain strength of the head chip 2. Further, the holding plate 3 has an opening 31 in its central portion such that the piezoelectric element 24 on the upper surface of the head chip 2 is housed inside the opening 31.

The connection member 4, which is a wiring member including, for example, a flexible print circuit (FPC), is bonded close to a rear side of the upper surface of the holding plate 3 such that a width direction of the connection member 4 is along the left-right direction of the holding plate 3. The connection member 4 is electrically connected by a bonding wire 41 to the piezoelectric element 24. The bonding wire 41 is disposed to pass through the opening 31 which is disposed in the center portion of the holding plate 3. The connection member 4 is also connected to a drive circuit 60 (see FIG. 8). Thereby, power is supplied from the drive circuit 60 to the piezoelectric element 24 via the connection member 4 and the bonding wire 41.

The ink flow path members 5 are bonded one to each of opposing end portions of the upper surface of the holding plate 3 in the left-right direction. One of the ink flow path members 5 includes an ink supply flow path 501 for supplying ink into the head chip 2 and an ink circulation flow path 504 for discharging ink from inside the head chip 2. The other one of the ink flow path members 5 includes an ink supply flow path 502 for supplying ink into the head chip 2 and an ink circulation flow path 503 for discharging ink from inside the head chip 2.

Hereinafter, detailed descriptions will be given of the head chip 2, the holding plate 3, and the ink flow path members 5.

[Head Chip]

Figure 4:
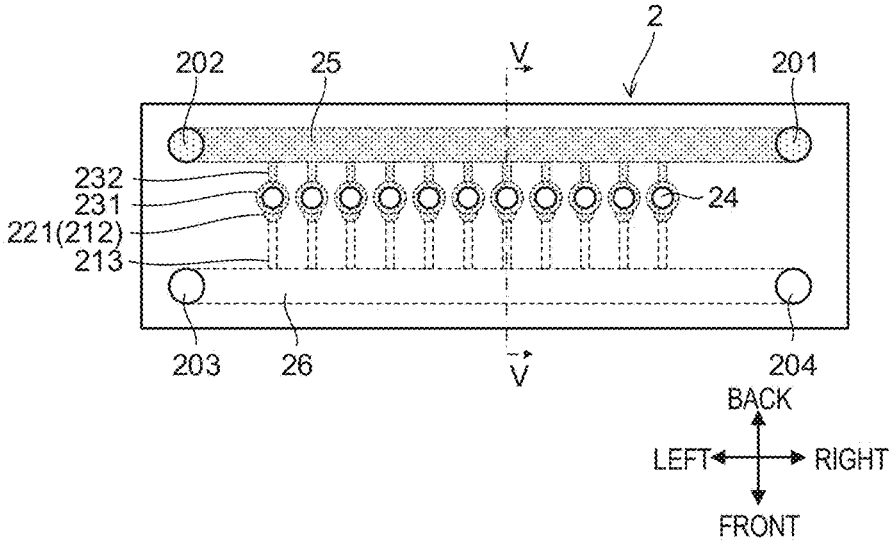
FIG. 4 is a plan view of a head chip of the ink jet head.

FIG. 4 is a plan view of the head chip 2. In FIG. 4, for convenience, a configuration inside the head chip 2 is indicated by the broken lines. An ink flow path from a common supply flow path 25 to each of communication holes 221 is indicted with mesh hatching.

The head chip 2 includes a plurality of piezoelectric elements 24 aligned on the upper surface thereof in the left-right direction, ink supply ports 201 and 202 for supplying ink into the head chip 2 from the ink flow path members 5, ink circulation ports 203 and 204 for discharging ink from inside the head chip 2 into the ink flow path members 5, and so on.

Figure 5:
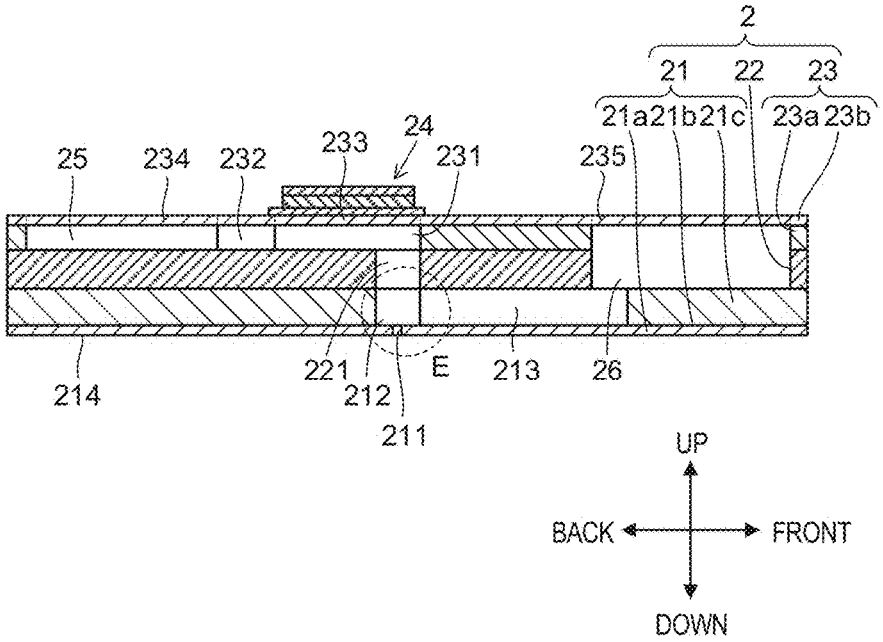
FIG. 5 is a sectional view of the head chip, taken along line (V)-(V) in FIG. 4.

FIG. 5 is a sectional view of the head chip 2 taken along line (V)-(V) in FIG. 4. The head chip 2 includes a nozzle plate 21, an intermediate plate 22, and a body plate 23, which are laid one on another in this order from the bottom and integrated with each other.

(Nozzle Plate)

The nozzle plate 21 is a substrate disposed in the lowermost layer of the head chip 2, and includes, for example, a silicon-on-insulator (SOI) wafer composed of three layers including a nozzle layer 21*a*, a bonding layer 21*b*, and a nozzle support layer 21*c*.

The nozzle layer 21*a* is a layer in which the nozzle 211 for ejecting ink droplets is formed, and includes an Si substrate having a thickness of, for example, 10 to 20 μm. A nozzle surface 214, which is a lower surface of the nozzle layer 21*a*, has formed thereon an ink-repellent film (unillustrated). The bonding layer 21*b* includes an $SiO_2$ substrate having a thickness of, for example, 0.3 to 1.0 μm. The nozzle support layer 21*c* includes an Si substrate having a thickness of, for example 100 to 300 μm. The nozzle support layer 21*c* has formed therein the following parts: a large-diameter part 212 which communicates with the nozzle 211 and has a diameter larger than that of the nozzle 211; and a circulation flow path part 213 which communicates with the large-diameter part 212. The circulation flow path part 213 diverges, via the large-diameter part 212, from a flow path of ink flowing from the pressure chamber 231 to the nozzle 211, and forms a flow path for circulating ink discharged from the pressure chamber 231.

In the present embodiment, the nozzle 211 has a circular shape as a sectional shape taken in a direction perpendicular to an ink ejection direction, but this is not meant as a limitation, and the sectional shape may be any shape as long as the shape allows ink to be ejected. For example, the sectional shape of the nozzle 211 may be the shape of a polygon, such as a quadrangle and a hexagon. In this case, a later-described diameter D of the nozzle 211 may be defined as a diameter of a circumscribed circle of the polygon. When a center of the circumscribed circle is on a diagonal line of the polygon, the diameter D may be defined as having a length of the diagonal line.

Since the nozzle layer 21*a* and the nozzle support layer 21*c* each include an Si substrate, it is possible to process the nozzle layer 21*a* and the nozzle support layer 21*c* easily by dry etching or wet etching.

The circulation flow path part 213 is formed in the nozzle support layer 21*c* with a space facing the bonding layer 21*b*, and thus is produced by processing with fine accuracy. Here, alternatively, the circulation flow path part 213 may be formed with a space facing the nozzle layer 21*a* by removing the bonding layer 21*b* by a wet etching process using a buffered hydrofluoric acid (BHF), etc., after forming the space facing the bonding layer 21*b*.

(Intermediate Plate)

The intermediate plate 22 includes a glass substrate having a thickness of, for example, about 100 to 300 μm, and has a communication hole 221 formed therein at a position corresponding to the large-diameter part 212 of the nozzle plate 21. The communication hole 221 is formed to penetrate the intermediate plate 22 in its thickness direction to achieve communication between the pressure chamber 231 and the large-diameter part 212, and functions as an ink flow path when ink is ejected. By adjusting a shape of the ink flow path in the communication hole 221 by reducing a diameter of the communication hole 221 somewhere along the ink flow path, for example, it is possible to adjust kinetic energy applied to the ink when the ink is ejected.

Used preferably as the glass substrate of the intermediate plate 22 is a borosilicate glass (for example, Tempax glass).

(Body Plate)

The body plate 23 includes a pressure chamber layer 23*a* and an oscillation layer 23*b*. The pressure chamber layer 23*a* includes, for example, an Si substrate having a thickness of, for example, about 100 to 300 μm. The pressure chamber layer 23*a* has formed therein a plurality of pressure chambers 231 which communicate with communication holes 221 of the intermediate plate 22 and have a substantially circular shape in plan view, a common supply flow path 25 for supplying ink commonly to the plurality of pressure chambers 231, and inlets 232 via which the plurality of pressure chambers 231 individually communicate with the common supply flow path 25 so as to supply ink inside the common supply flow path 25 into the pressure chambers 231. Each inlet 232 includes a narrow portion which is a flow path narrower than the pressure chamber 231, such that it is difficult for pressure applied to the pressure chamber 231 to escape via the inlet-232 side. The narrow portion may have any shape that makes it a flow path narrower than the pressure chamber 231, and the shape may be suitably changed.

The oscillation layer 23*b* is a thin elastically deformable Si substrate having a thickness of, for example, about 20 to 30 μm, and the oscillation layer 23*b* is laid on an upper surface of the pressure chamber layer 23*a*. In the oscillation layer 23*b*, an upper surface of the pressure chamber 231 functions as a diaphragm 233. The diaphragm 233 oscillates in accordance with the operation of the piezoelectric element 24 provided on an upper surface of the diaphragm 233, and thereby, it is possible to apply pressure to the ink in the pressure chamber 231.

Further, in the intermediate plate 22 and the pressure chamber layer 23*a*, there is formed a common circulation flow path 26 where flows of ink from a plurality of circulation flow path parts 213 formed in the nozzle support layer 21*c* join together.

The oscillation layer 23*b* includes a damper 234 formed on an upper surface of the common supply flow path 25, and a damper 235 formed on an upper surface of the common circulation flow path 26. The dampers 234 and 235 are slightly elastically deformable when, for example, pressure is applied all at once to the pressure chamber 231 such that the ink flows from the pressure chamber 231 into the common circulation flow path 26 all at once, and the dampers 234 and 235 are provided for the purpose of preventing abrupt change of pressure in the ink flow path.

In the configuration discussed above, ink flows in the following manner. First, ink is supplied from the ink supply ports 201 and 202 into the common supply flow path 25, all illustrated in FIG. 4. Next, the ink flows, in order, into the inlets 232, the pressure chambers 231, the communication holes 221, the large-diameter parts 212, and the circulation flow path parts 213, which diverge from the common supply flow path 25 and respectively correspond to nozzles 211. Next, flows of the ink from respective circulation flow path parts 213 join in the common circulation flow path 26, and the ink is discharged from the ink circulation ports 203 and 204, to then flow through the ink circulation flow path 504 (see FIG. 2), and returns to a circulation subtank 63 (see FIG. 7).

The above description has dealt with an example where the circulation flow path part 213 is formed in the nozzle plate 21, but the circulation flow path part 213, which needs to be disposed closer to the nozzle than the body plate 23 which has the pressure chamber 231 formed therein, may alternatively be formed in the intermediate plate 22, for example. However, in order to securely guide and remove from inside the nozzle 211, by the oscillation of a later-described ink meniscus, the ink that has failed to be prevented from becoming dry and thus has become more viscous near an exit of the nozzle 211, it is desirable that the circulation flow path part 213 be disposed close to the nozzle 211, and in this regard, it is preferable that the circulation flow path part 213 be disposed in the nozzle plate 21.

[Holding Plate]

As illustrated in FIG. 2 and FIG. 3, the holding plate 3 is bonded to the upper surface of the head chip 2 with an adhesive, and includes an Si substrate or a glass substrate, each with a thickness of, for example, about 0.5 mm to 3.0 mm. By using the Si substrate or the glass substrate in the holding plate 3, the holding plate 3 is given an expansion coefficient close to expansion coefficients of the substrates included in the head chip 2, and thus, even in a case where a thermosetting adhesive is used as the adhesive and a method including a heating process is used as the bonding method, it is possible to prevent warp between the holding plate 3 and the head chip 2.

The holding plate 3 is formed in a shape, in plan view, that is larger than the head chip 2 both in the front-back and left-right directions. In particular, both end portions of the holding plate 3 in the left-right direction are disposed more outward than the head chip 2 by a large amount. In a center portion of the holding plate 3, an opening 31 is formed through the holding plate 3 to be large enough to surround all piezoelectric elements 24 aligned on the upper surface of the head chip 2 when the holding plate 3 is bonded with the head chip 2.

The opening 31 is formed in a rectangular shape extending along the left-right direction and sized large enough to surround all the piezoelectric elements 24 but not large enough to reach positions of the ink supply ports 201 and 202 and the ink circulation ports 203 and 204 provided on both end portions of the upper surface of the head chip 2. When viewed from above the holding plate 3, each nozzle 211 formed in the nozzle plate 21 is located inside the opening 31.

A lower half portion of the opening 31 of the holding plate 3 is formed to have a larger space than an upper half portion of the opening 31. The lower half portion of the opening 31 has an outer shape sized such that, when the holding plate 3 and the head chip 2 are bonded together, the piezoelectric elements 24 and the common supply flow path 25 and the common circulation flow path 26 disposed in the front-back direction of the piezoelectric elements 24 are all located inside the lower half portion of the opening 31.

As illustrated in FIG. 2, near the two end portions of the holding plate 3 in the left-right direction, through holes 301, 302, 303, and 304 are formed, each having a size large enough to surround one of the ink supply ports 201 and 202 and the ink circulation ports 203 and 204, which are disposed on the upper surface of the head chip 2. The through holes 301 to 304 are used as ink flow paths to establish communication between the ink flow path members 5 and the head chip 2.

[Ink Flow Path Member]

The ink flow path members 5 are formed of a synthesized resin such as a poly phenylene sulfide resin (PPS), each in a shape of a box with an open bottom, and are disposed one on each end portion of an upper surface of the holding plate 3 in the left-right direction.

The left and right ink flow path members 5 have similar structures, and thus, hereinafter, the configuration of only the right ink flow path member 5 will be described, and the description of the left ink flow path member 5 will be omitted.

Figure 6:
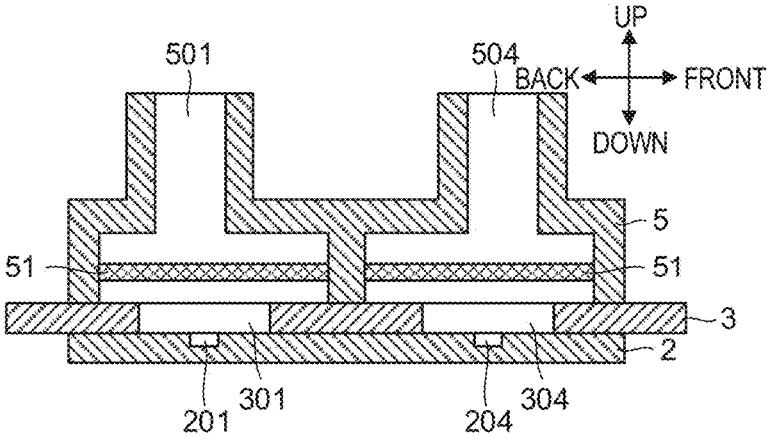
FIG. 6 is a sectional view of an ink flow path member of the ink jet head, taken along line (VI)-(VI) in FIG. 2.

FIG. 6 is a sectional view of the ink flow path member 5 taken along line (VI)-(VI) in FIG. 2. The ink flow path member 5 includes an ink supply flow path 501 which functions as a flow path to supply ink and an ink circulation flow path 504 which functions as a flow path to discharge ink. Inside the ink flow path member 5, a filter 51 is disposed with respect to each of the ink supply flow path 501 and the ink circulation flow path 504 to remove impurities such as undesirable substances and air bubbles in the ink flowing inside the ink flow path member 5. The filter 51 is a mesh of metal such as stainless steel, etc., for example, and bonded to the resin inside the ink flow path member 5.

[Circulation Mechanism]

Figure 7:
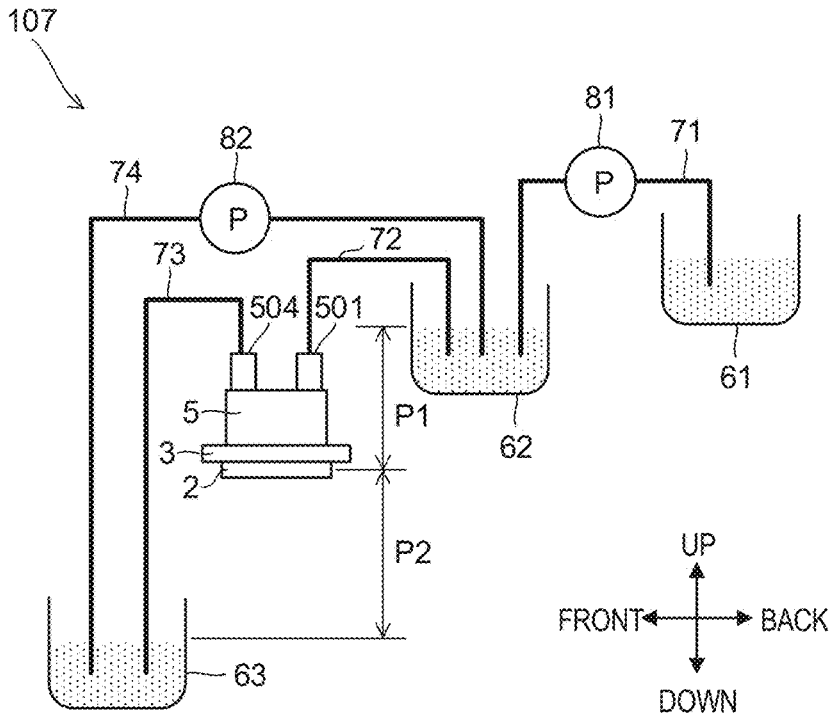
FIG. 7 is an explanatory diagram schematically illustrating a configuration of a circulation mechanism incorporated in the ink jet printer.

Next, a description will be given of the circulation mechanism 107 for ink. FIG. 7 is an explanatory diagram schematically illustrating a configuration of the circulation mechanism 107. The circulation mechanism 107 at least has a supply subtank 62, a circulation subtank 63, ink flow paths 72, 73, and 74, and a pump 82.

The ink supply flow path 501 of the ink flow path member 5 is connected via the ink flow path 72 to the supply subtank 62. Thereby, it is possible to supply ink from the supply subtank 62 into the ink flow path member 5, and to supply the ink via the through hole 301 (see FIG. 6) and the ink supply port 201 (see FIG. 6) into the head chip 2.

The ink circulation flow path 504 of the ink flow path member 5 is connected via the ink flow path 73 to the circulation subtank 63. Thereby, it is possible to discharge, into the circulation subtank 63, ink that has been discharged via the ink supply port 204 (see FIG. 6) and the through hole 304 (see FIG. 6) of the head chip 2 into the ink flow path member 5.

The supply subtank 62 and the circulation subtank 63 are disposed at different positions in the up-down direction (the gravity direction) with respect to a position reference surface where the common supply flow path 25 and the common circulation flow path 26 inside the head chip 2 are disposed. And, with pressure P1 and pressure P2, respectively resulting from positional differences between the positional reference surface and water heads of the supply subtank 62 and the circulation subtank 63, it is possible to circulate the ink inside the head chip 2.

The supply subtank 62 is connected via the ink flow path 74 to the circulation subtank 63, and it is possible to return ink from the circulation subtank 63 to the supply subtank 62 by means of the pump 82.

The supply subtank 62 is connected via the ink flow path 71 to a main tank 61, and it is possible to supply ink from the main tank 61 to the supply subtank 62 by means of the pump 81.

Accordingly, by appropriately adjusting a difference between the water heads of the supply subtank 62 and the circulation subtank 63 and the positions of the subtanks in the up-down direction (the gravity direction), it is possible to adjust the pressure P1 and the pressure P2, and thus to circulate the ink inside the head chip 2 at an appropriate circulation flow rate.

[Details of Piezoelectric Element]

There is no particular limitation on the piezoelectric element to be used in the present embodiment so long as it is capable of causing ink to be ejected from a nozzle and is also capable of oscillating an ink meniscus. Hereinafter, a description will be given of the details of the piezoelectric element 24 as an example of piezoelectric elements.

Figure 8:
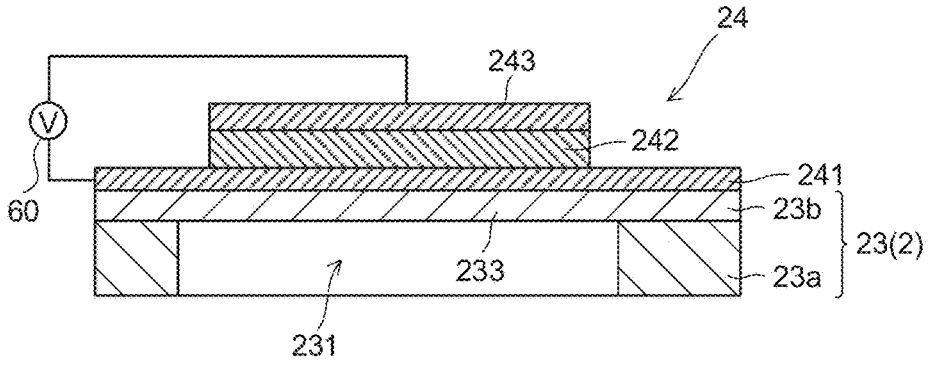
FIG. 8 is a sectional view of a piezoelectric element of the ink jet head.

FIG. 8 is a sectional view of the piezoelectric element 24. The piezoelectric element 24 is supported on the body plate 23 of the head chip 2, and formed of a lower electrode 241, a piezoelectric thin film 242, and an upper electrode 243, which are laid one on another in this order from the head chip 2 side.

The lower electrode 241 is a common electrode which is shared by the plurality of pressure chambers 231, and includes a layer of platinum (Pt) having a thickness of, for example, about 0.1 μm. Here, the lower electrode 241 may have an adhesion layer of titanium (Ti) or a titanium oxide (TiOx) to be disposed between the Pt layer and the head chip 2.

The piezoelectric thin film 242 includes a ferroelectric thin film made of lead zirconate titanate (PZT) or the like, and one piezoelectric thin film 242 is disposed corresponding to each pressure chamber 231. The piezoelectric thin film 242 has a thickness of, for example, equal to or more than 1 μm but equal to or less than 10 μm. Usable as a method for forming the piezoelectric thin film 242 are various methods including chemical film forming methods such as the chemical-vapor deposition (CVD) method, physical methods such as the sputtering method and the ion plating method, liquid phase growth methods such as the sol-gel method, and printing methods.

The upper electrode 243 is an individual electrode disposed corresponding to each pressure chamber 231, and is formed with a platinum (Pt) layer having a thickness of, for example, about 0.1 μm. Here, the upper electrode 243 may have an adhesion layer to be disposed between the Pt layer and the piezoelectric thin film 242. Alternatively, the upper electrode 243 may be formed by using gold (Au) instead of Pt.

The piezoelectric element 24 is connected to the drive circuit 60 via the connection member 4 (see FIG. 3). The drive circuit 60 is a drive controller which controls the piezoelectric element 24, and generates a driving signal for driving the piezoelectric element 24 and feeds the signal to the piezoelectric element 24. The drive circuit 60 may be disposed in the ink jet head 1, or may be disposed outside the ink jet head 1 but inside the ink jet printer 100 to be electrically connected to the piezoelectric element 24 disposed in the ink jet head 1. In the case where the drive circuit 60 is disposed in the ink jet head 1, the ink jet head 1 incorporating the drive circuit 60 may be referred to as an ink jet driving apparatus. In the case where the drive circuit 60 is disposed outside the ink jet head 1 to be electrically connected to the piezoelectric element 24, the ink jet printer 100 incorporating the drive circuit 60 and the ink jet head 1 may be referred to as an ink jet driving apparatus.

In the ink jet driving apparatus, the piezoelectric element 24 is driven based on the driving signal fed from the drive circuit 60. Specifically, when the driving signal (a driving voltage) is applied from the drive circuit 60 to the lower electrode 241 and the upper electrode 243, the piezoelectric thin film 242 expands or contracts in a direction perpendicular to its thickness direction in accordance with a difference in potential between the lower electrode 241 and the upper electrode 243. Then, a difference in length between the piezoelectric thin film 242 and the diaphragm 233 causes curvature in the diaphragm 233, and the diaphragm 233 is displaced (curved, oscillated) in its thickness direction.

Accordingly, with ink stored in the pressure chamber 231, during an ejection time, during which ink is ejected, the oscillation of the diaphragm 233 described above causes a pressure wave to be transmitted to the ink stored in the pressure chamber 231, and thereby, the ink is caused to be ejected through the nozzle 211 as an ink droplet. On the other hand, during a non-ejection time, during which ink is not ejected, a driving signal having an amplitude smaller than during the ejection time is generated by the drive circuit 60 and fed to the piezoelectric element 24, and the piezoelectric element 24 is driven based on the driving signal to cause an ink meniscus (an interface between the ink and air) inside the nozzle 211 to oscillate, details of which will be described later.

[Position of Circulation Flow Path Portion]

Figure 9:
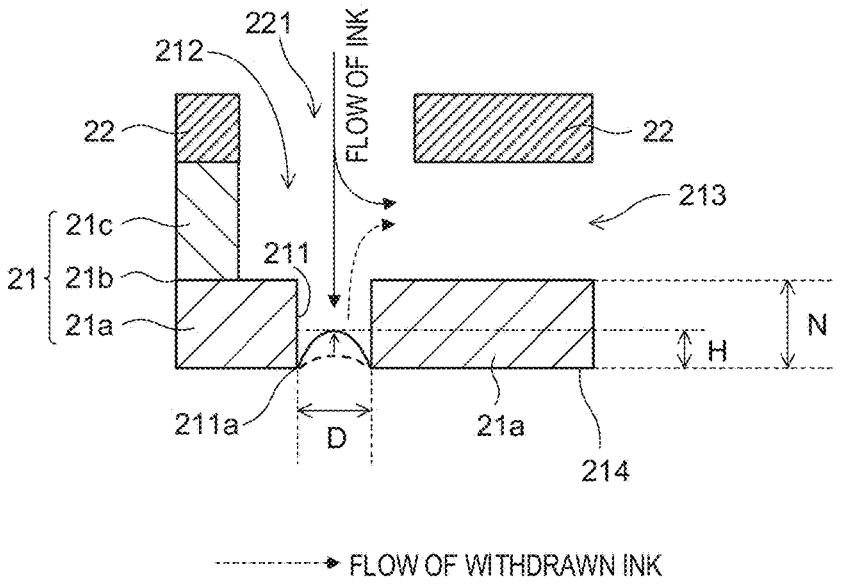
FIG. 9 is a sectional view illustrating, in an enlarged manner, a part E encircled by the broken-line circle in FIG. 5.

Next, a description will be given of the details of a position of the circulation flow path part 213 described above. FIG. 9 is a sectional view illustrating, in an enlarged manner, a portion E illustrated in FIG. 5. In the nozzle 211, a diameter of the nozzle 211 measured at its exit 211*a*, which is a portion of the nozzle 211 that is the farthest from the pressure chamber 231 (see FIG. 5), is represented by D (μm). Here, the diameter D (μm) is preferably equal to or larger than 10 μm but equal to or smaller than 120 μm, for example, but needless to say, there is no particular limitation on the diameter D (μm). Further, a distance between the exit 211*a* and a position in the circulation flow path part 213 nearest the exit 211*a* in a direction (a thickness direction of the nozzle plate 21, the ink-ejection direction) perpendicular to a surface (a nozzle surface 214) including a hole at the exit 211*a* is represented by N (μm). At this time, in the present embodiment, the distance N and the diameter D are set such that conditional formula (1) below is satisfied:

$$N \leq 3.47D \quad (1)$$

That is, the circulation flow path part 213 is formed at such a position in the nozzle plate 21 that satisfies conditional formula (1). Here, 3.47D means 3.47×D. When conditional formula (1) is satisfied, the circulation flow path part 213 is arranged near the exit 211*a* of the nozzle 211 in the thickness direction of the nozzle plate 21. Thereby, it becomes easy to withdraw the ink from inside the nozzle 211 and circulate the ink via the circulation flow path part 213.

Further, by satisfying conditional formula (1), it is possible, as illustrated in FIG. 9, to increase an area where ink flowing from the pressure chamber 231 (see FIG. 5) into the circulation flow path part 213 come into contact with ink withdrawn to flow from near the nozzle 211 toward the circulation flow path part 213. Thereby, the ink existing near the nozzle 211 is withdrawn as if sucked into the flow of ink circulating from the pressure chamber 231 via the circulation flow path part 213, and this facilitates the withdrawal of the ink existing near the exit 211*a* of the nozzle 211.

Conditional formula (1) defines a condition for later-described conditional formula (2) to hold. That is, whenever a later-described lower limit value (0.16N) of conditional formula (2) is equal to or lower than a later-described upper limit value (0.555D) of conditional formula (2), conditional formula (2) holds. When $0.16N \leq 0.555D$ holds, then $N \leq 0.555D/0.16 = 3.47D$ holds, and conditional formula (1) is obtained. Accordingly, when conditional formula (1) is not satisfied as in a case where, for example, D=10 μm and N=40 μm, conditional formula (2) no longer holds (that is, such a withdrawal amount H as satisfies conditional formula (2) does not exist), and thus it becomes impossible to obtain a decapping effect (an effect of preventing reduction of ejection speed) from circulation and later-described oscillation of an ink meniscus.

Here, from the perspective of facilitating control of such a withdrawal amount H that satisfies formula (2), which will be described later, with respect to N and D, it is more preferable to satisfy the following conditional formula (1a), and it is still more preferable to satisfy the following conditional formula (1b). That is, $$N \leq 3.00D \quad (1a)$$

$$N \leq 2.00D \quad (1b)$$

Here, in a case where the circulation flow path part 213 faces the bonding layer 21*b* of the nozzle plate 21, that is, in a case where the circulation flow path part 213 is formed in the nozzle support layer 21*c* of the nozzle plate 21, and a surface of the bonding layer 21*b* forms a bottom surface (a surface on the nozzle-211 side) of the circulation flow path part 213, the distance N described above is equal to a sum of a thickness of the nozzle layer 21*a* and a thickness of the bonding layer 21*b* of the nozzle plate 21. In a case where the circulation flow path part 213 faces the nozzle layer 21*a* of the nozzle plate 21, that is, in a case where the circulation flow path part 213 is formed in the nozzle support layer 21*c* and the bonding layer 21*b* of the nozzle plate 21, and a surface of the nozzle layer 21*a* forms the bottom surface of the circulation flow path part 213, the distance N mentioned above is equal to the thickness of the nozzle layer 21*a*. The nozzle 211, which has been described above, has a shape such that a nozzle diameter is constant in the ink-ejection direction, but alternatively, the nozzle diameter may change continuously or in stages in the ink-ejection direction. For example, the nozzle 211 may be formed with a two-diameter hole where the nozzle diameter changes in the ink-ejection direction in two stages.

[Oscillation of Ink Meniscus during Non-Ejection Time]

The inventor of the present invention has discovered the following: in a case where, from the perspective of partly withdrawing ink from near the nozzle into the circulation flow path part, when a diameter of a hole at an exit of a nozzle is represented by D (μm), the exit being a portion of the nozzle that is farthest from a pressure chamber, and a distance between the exit and a position in a circulation flow path part that is nearest the exit is represented by N (μm), N≤3.47D is satisfied, then, by oscillating an ink meniscus under predetermined conditions determined by taking into consideration the ink withdrawal amount, details of the conditions being described later, even when ink near the exit of the nozzle has failed to be prevented from becoming dry and thus has become more viscous, it is possible to increase the possibility of successfully removing the ink from inside the nozzle, whereby it is possible to avoid the degradation of the ejection properties attributable to the ink. Hereinafter, a detailed description will be given of oscillation of the ink meniscus.

In the present embodiment, during the non-ejection time, during which ink is not ejected, the drive circuit 60 generates a driving signal for withdrawing ink from the exit 211*a* of the nozzle 211 to the pressure chamber 231 side, to a position that is away from the exit 211*a* by a distance that is equal to or more than 0.16N but equal to or less than 0.555D and for causing an ink meniscus to oscillate, and the drive circuit 60 applies the driving signal to the piezoelectric element 24 functioning as a driving element. Here, 0.16N means 0.16×N, and 0.555D means 0.555×D. The distance D may have a value that is, for example, equal to or more than 10 μm but equal to or less than 30 μm, and the distance N may have a value that is, for example, equal to or more than 10 μm but equal to or less than 20 μm, but the distances are not limited to these ranges. The details of the ink withdrawal amount will be described later.

Figure 10:
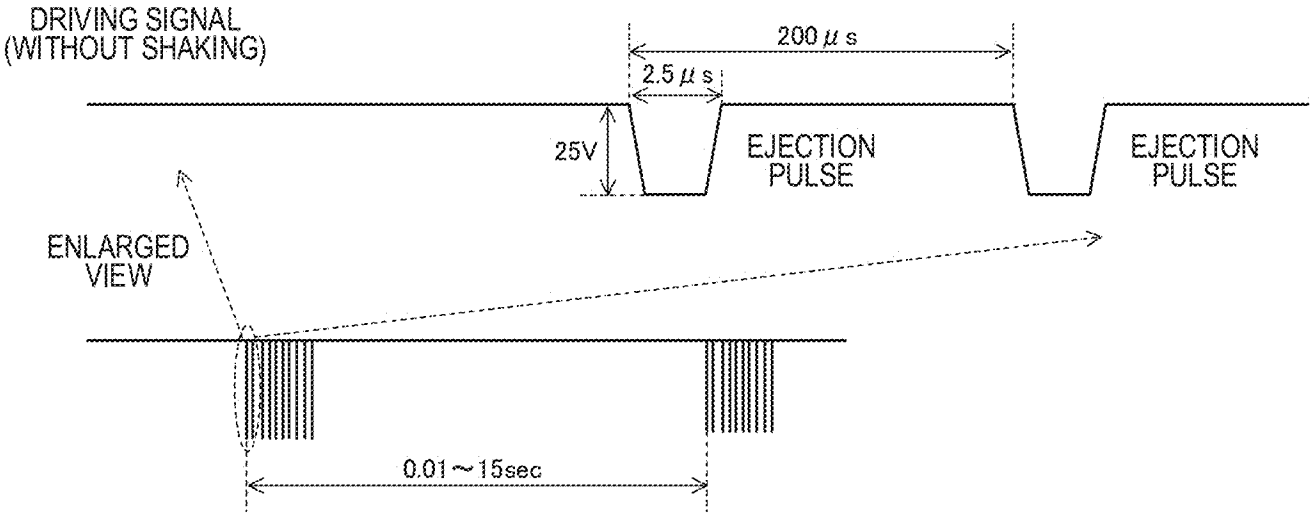
FIG. 10 is an explanatory diagram illustrating an example of a driving signal which does not cause an ink meniscus to oscillate during a non-ejection time and causes ink to be ejected during an ejecting time.
Figure 11:
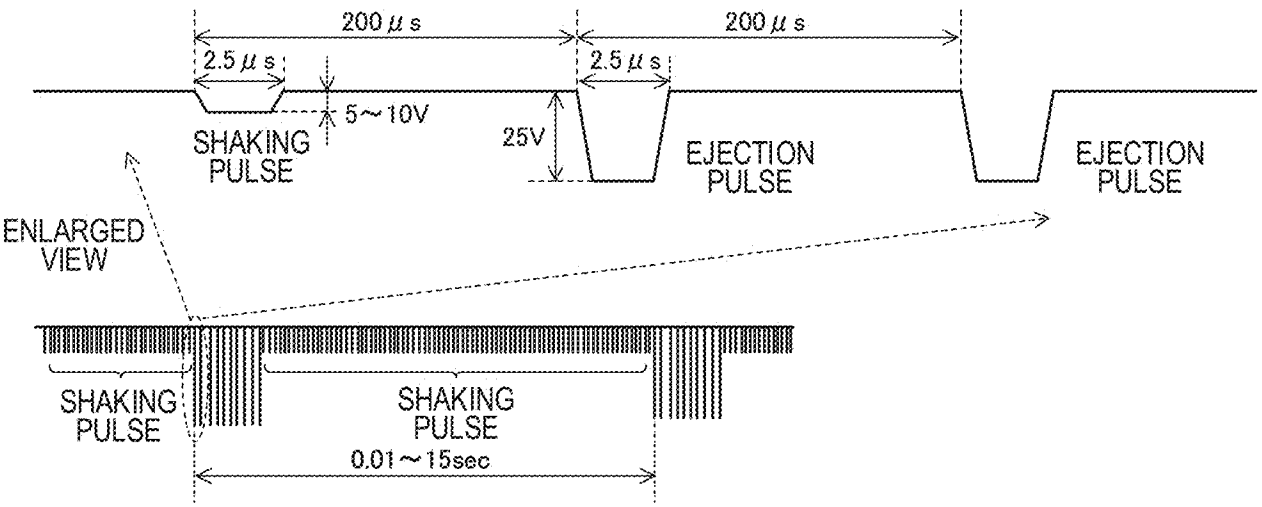
FIG. 11 is an explanatory diagram illustrating an example of a driving signal which causes the ink meniscus to oscillate during the non-ejection time and causes the ink to be ejected during the ejecting time.

FIG. 10 illustrates an example of a driving signal (without a shaking pulse) for not oscillating an ink meniscus during the non-ejection time and ejecting ink during the ejection time, and FIG. 11 illustrates an example of a driving signal (with a shaking pulse) for oscillating an ink meniscus during the non-ejection time and ejecting ink during the ejection time. In a case where the amplitude of a driving pulse (an ejection pulse) during the ejection time is, for example, 25 V in potential difference, the amplitude of a driving pulse (a shaking pulse) during the non-ejection time is, for example, 5 to 10 V in potential difference, and thus is smaller than the amplitude of the driving pulse during the ejection time. Thus, during the non-ejection time, it is possible to drive the piezoelectric element 24 to such an extent that the piezoelectric element 24 does not cause ink to be ejected, to thereby cause an ink meniscus inside the nozzle 211 to oscillate slightly.

When the driving signal illustrated in FIG. 10 is fed to the piezoelectric element 24, the piezoelectric element 24 does not cause the ink meniscus to oscillate during the non-ejection time, and thus there is a risk that ink inside the nozzle 211 (in particular, ink existing near the exit 211*a*) will become dry and thus more viscous to cause degradation of the ink ejection properties (for example, the ejection speed). However, when the drive circuit 60 generates the driving signal illustrated in FIG. 11 and feeds it to the piezoelectric element 24, the piezoelectric element 24 causes the ink meniscus to oscillate during the non-ejection time and makes the ink inside the nozzle 211 flow, and thus it is possible to moderate the drying, and the increase in viscosity, of the ink to some extent.

Figure 12:
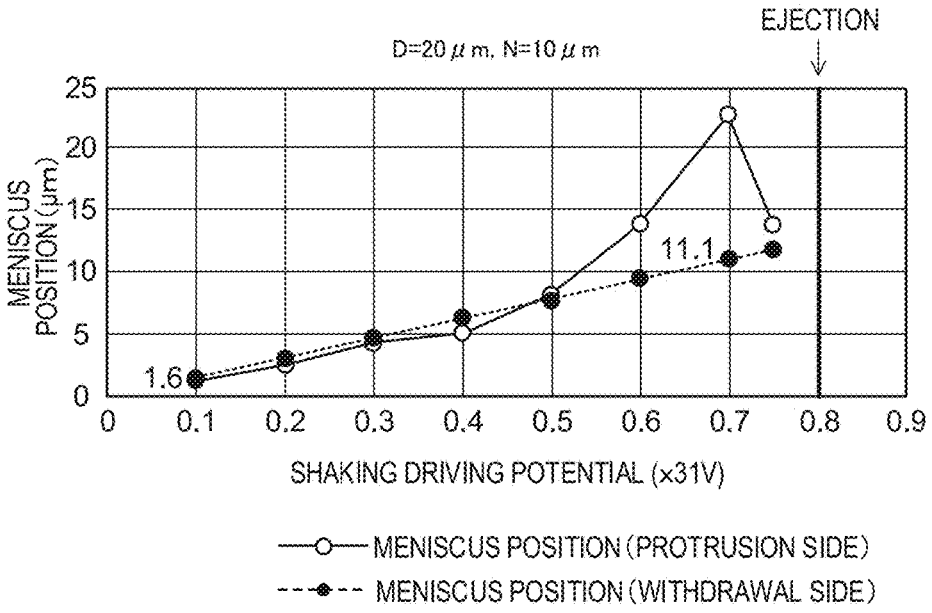
FIG. 12 is a graph showing a relationship between shaking driving potential during the non-ejection time and position of the ink meniscus when it oscillates.
Figure 13:
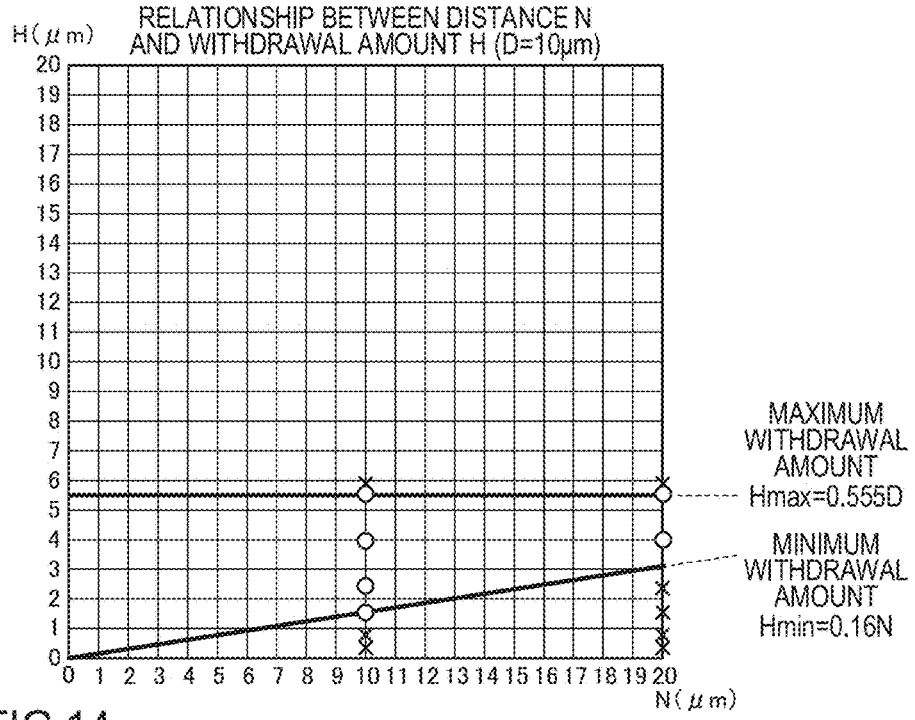
FIG. 13 is an explanatory diagram plotting, on a coordinate plane, a relationship between nozzle length and withdrawal amount in a case where the nozzle has a diameter of 10 μm.
Figure 14:
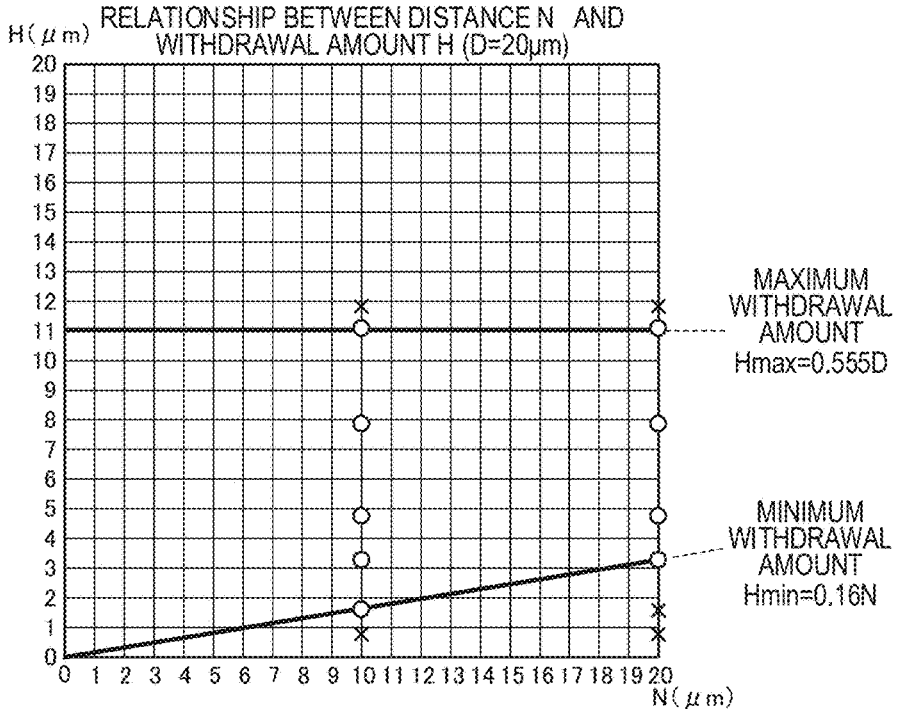
FIG. 14 is an explanatory diagram plotting, on a coordinate plane, a relationship between nozzle length and withdrawal amount in a case where the nozzle has a diameter of 20 μm.
Figure 15:
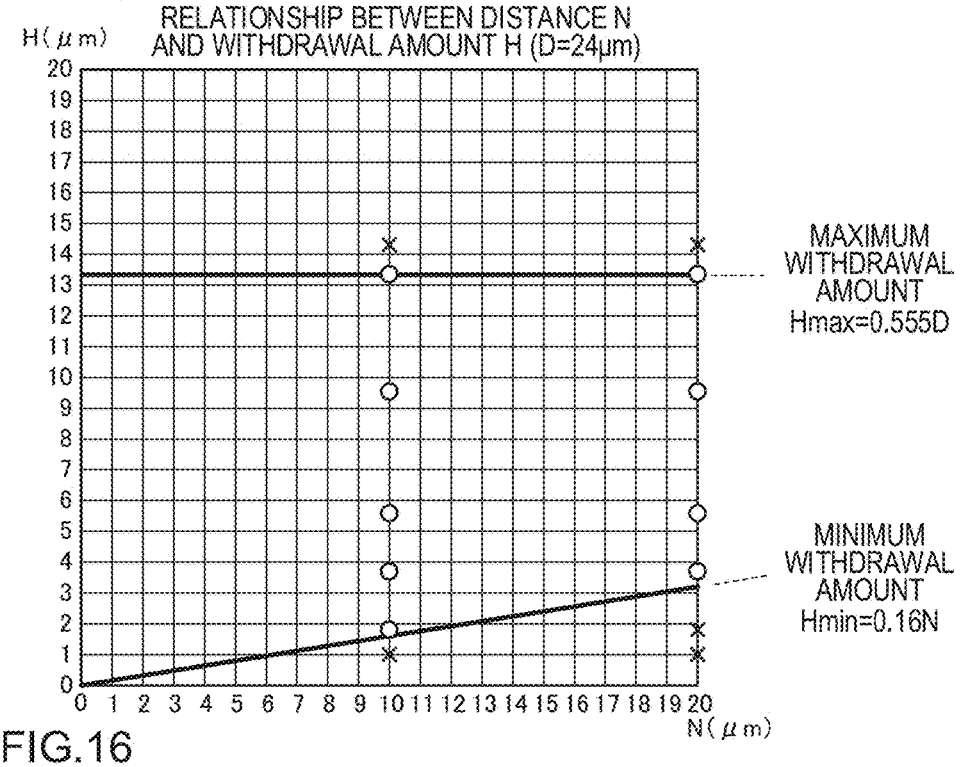
FIG. 15 is an explanatory diagram plotting, on a coordinate plane, a relationship between nozzle length and withdrawal amount in a case where the nozzle has a diameter of 24 μm.
Figure 16:
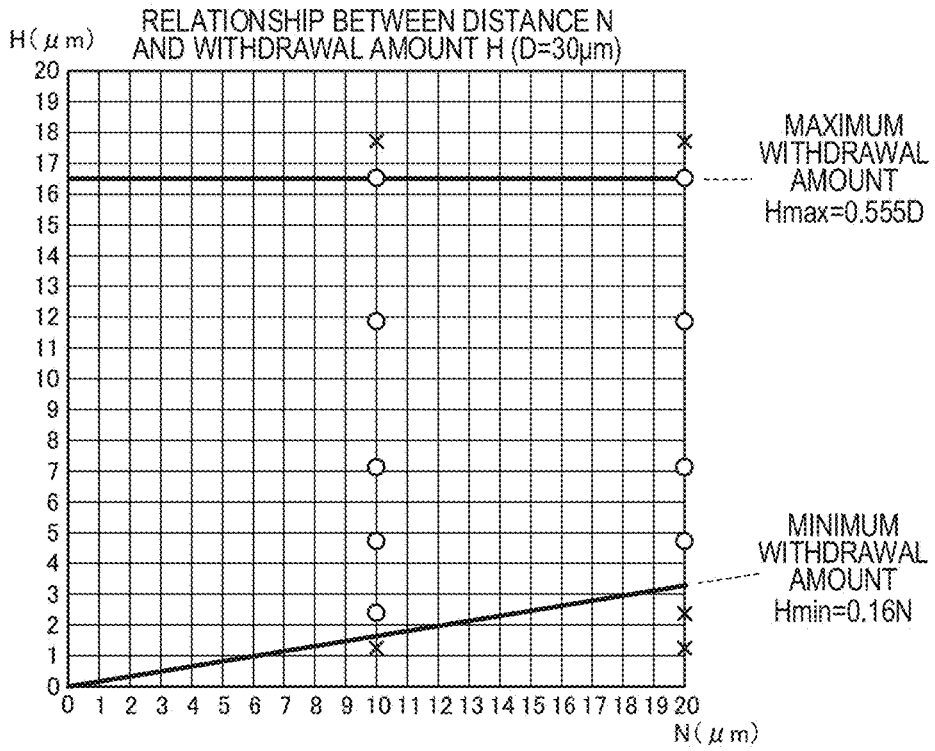
FIG. 16 is an explanatory diagram plotting, on a coordinate plane, a relationship between nozzle length and withdrawal amount in a case where the nozzle has a diameter of 30 μm.

FIG. 12 shows results of an investigation conducted on a relationship between a potential (a shaking driving potential) for oscillating an ink meniscus during the non-ejection time and an ink meniscus position measured when the ink meniscus was oscillated in a case where the diameter D of the hole at the exit 211*a* of the nozzle 211 was 20 μm (the distance N was 10 μm, N=0.5D). Here, the ink meniscus position represented by a vertical axis corresponds to the ink withdrawal amount by which the ink was withdrawn from the exit 211*a* of the nozzle 211 to the pressure chamber 231 side, or corresponds to an ink protrusion amount by which the ink protruded from the exit 211*a* to a side opposite from the pressure chamber 231. An ink meniscus withdrawal position is inside the nozzle 211 and thus is difficult to measure from outside, and thus an ink meniscus withdrawal amount (the ink meniscus withdrawal position) was estimated, by simulation, from an ink meniscus protrusion amount (an ink meniscus protrusion position) measured when the ink meniscus was caused to oscillate to thereby protrude from the exit 211*a*.

From FIG. 12, in a case where the shaking driving potential is 0.1(×31V), the ink meniscus protrusion amount is 1.3 μm, and the ink meniscus withdrawal amount is estimated to be 1.6 μm. Also from FIG. 12, the ink meniscus is withdrawn the most when the shaking driving potential is 0.7(×31V), and when the shaking driving potential exceeds 0.7(×31V), too much ink is withdrawn and the ink meniscus is caused to be unstable, and this may sometimes affect ink ejection. Further, when the shaking driving potential reaches 0.8(×31V), which is approximately 25 V, ink is ejected through the nozzle 211.

Accordingly, in a case where the diameter D of the nozzle 211 is 20 μm, from the perspective of removing ink from inside the nozzle 211 to avoid the degradation of the ejection properties caused by the ink even in a case where the ink has failed to be prevented from becoming dry and more viscous near the exit 211*a* of the nozzle 211 despite the withdrawal of the ink performed while stabilizing the ink meniscus, it is necessary for the shaking driving potential to be equal to or more than 0.1(×31V) but equal to or less than 0.7(×31V). In this range of the shaking driving potential, the ink meniscus withdrawal amount is, from FIG. 12, equal to or more than 1.6 μm but equal to or less than 11.1 μm. The ink meniscus withdrawal amount 1.6 μm is 0.08 times the diameter D (20 μm), and the ink meniscus withdrawal amount 11.1 μm is 0.555 times the diameter D (20 μm), and thus, it is possible to say that under a condition where D=20 μm, the ink withdrawal amount is preferably equal to or more than 0.08 times the diameter D but equal to or less than 0.555 times the diameter D.

Here, the ink meniscus withdrawal amount 1.6 μm corresponds to the ink meniscus protrusion amount 1.3 μm as mentioned above, and the value 1.3 μm of the ink meniscus protrusion amount is equal to 0.065 times the diameter D of the nozzle 211. Also, from FIG. 12, the ink meniscus withdrawal amount 11.1 μm corresponds to the ink meniscus protrusion amount 23.0 μm, and is equal to 1.15 times the diameter D. Accordingly, it is possible to say that, under a condition of D=20 μm, when the ink meniscus protrusion amount by which the ink meniscus protrudes from the exit 211*a* is equal to or more than 0.065 times the diameter D of the exit 211*a* of the nozzle 211 but equal to or less than 1.15 times the diameter D, it is possible to achieve the above-mentioned range of the ink withdrawal amount (that is, equal to or more than 0.08 times the diameter D but equal to or less than 0.555 times the diameter D).

Next, appropriate ink withdrawal amounts will be discussed with respect to various amounts of the diameter D and the distance N (the nozzle length). As illustrated in FIG. 9, the ink withdrawal amount, that is, the distance between the ink meniscus and the exit 211*a* is represented by H (μm). Shown in Table 1 to Table 8 are the results of simulations of the ink withdrawal amount H generated by applying the shaking driving potential, and results of observations of ink ejection states in the simulations, in cases where the diameter D of the nozzle 211 were 10 μm, 20 μm, 24 μm, and 30 μm. Here, in Table 1 to Table 4, the distance N is constantly 10 μm, and in Table 5 to Table 8, the distance N is constantly 20 μm.

TABLE 1

| D = 10 μm, N = 10 μm | |
|---|---|
| Withdrawal Amount H (μm) | State of Ejection |
| 0.4 | Speed Reduced |
| 0.8 | Speed Reduced |
| 1.6 | Favorable |
| 2.4 | Favorable |
| 4.0 | Favorable |
| 5.6 | Favorable |
| 5.9 | Poor Ejection |

TABLE 2

| D = 20 μm, N = 10 μm | |
|---|---|
| Withdrawal Amount H (μm) | State of Ejection |
| 0.8 | Speed Reduced |
| 1.6 | Favorable |
| 3.2 | Favorable |
| 4.8 | Favorable |
| 7.9 | Favorable |
| 11.1 | Favorable |
| 11.9 | Poor Ejection |

TABLE 3

| D = 24 μm, N = 10 μm | |
|---|---|
| Withdrawal Amount H (μm) | State of Ejection |
| 1.0 | Speed Reduced |
| 1.9 | Favorable |
| 3.8 | Favorable |
| 5.7 | Favorable |
| 9.5 | Favorable |
| 13.3 | Favorable |
| 14.3 | Poor Ejection |

TABLE 4

| D = 30 μm, N = 10 μm | |
|---|---|
| Withdrawal Amount H (μm) | State of Ejection |
| 1.2 | Speed Reduced |
| 2.4 | Favorable |
| 4.8 | Favorable |
| 7.1 | Favorable |
| 11.9 | Favorable |

TABLE 4-continued

| D = 30 μm, N = 10 μm | |
|---|---|
| Withdrawal Amount H (μm) | State of Ejection |
| 16.7 | Favorable |
| 17.8 | Poor Ejection |

TABLE 5

| D = 10 μm, N = 20 μm | |
|---|---|
| Withdrawal Amount H (μm) | State of Ejection |
| 0.4 | Speed Reduced |
| 0.8 | Speed Reduced |
| 1.6 | Speed Reduced |
| 2.4 | Speed Reduced |
| 4.0 | Favorable |
| 5.6 | Favorable |
| 5.9 | Poor Ejection |

TABLE 6

| D = 20 μm, N = 20 μm | |
|---|---|
| Withdrawal Amount H (μm) | State of Ejection |
| 0.8 | Speed Reduced |
| 1.6 | Speed Reduced |
| 3.2 | Favorable |
| 4.8 | Favorable |
| 7.9 | Favorable |
| 11.1 | Favorable |
| 11.9 | Poor Ejection |

TABLE 7

| D = 24 μm, N = 20 μm | |
|---|---|
| Withdrawal Amount H (μm) | State of Ejection |
| 1.0 | Speed Reduced |
| 1.9 | Speed Reduced |
| 3.8 | Favorable |
| 5.7 | Favorable |
| 9.5 | Favorable |
| 13.3 | Favorable |
| 14.3 | Poor Ejection |

TABLE 8

| D = 30 μm, N = 20 μm | |
|---|---|
| Withdrawal Amount H (μm) | State of Ejection |
| 1.2 | Speed Reduced |
| 2.4 | Speed Reduced |
| 4.8 | Favorable |
| 7.1 | Favorable |
| 11.9 | Favorable |
| 16.7 | Favorable |
| 17.8 | Poor Ejection |

When the shaking driving potential during the non-ejection time is too low (below 0.1(×31V)), ink becomes dry and more viscous, which results in reduction of the ink ejection speed from a reference range (for example, ±5% of a reference speed). On the other hand, when the shaking driving potential during the non-ejection time is too high (above 0.7(×31V)), the ink meniscus becomes unstable to cause the ink ejection direction to become unstable as well, which results in poor ink ejection. In contrast to these cases, when the shaking driving potential is within the above-mentioned reference range, ink is ejected in a preferable manner.

FIG. 13 to FIG. 16 are graphs plotting, on coordinate planes, based on the numerical values in Table 1 to Table 8, the relationship between the distance N and the ink withdrawal amount H respectively in cases where the diameter D is 10 μm, 20 μm, 24 μm, and 30 μm. Here, in the figures, a circle indicates a point at which ink was ejected in a preferable manner, and a cross indicates a point at which the ink ejection speed was lowered or poor ink ejection occurred. From these figures, it is clear that Hmin, indicating a lower limit value (a minimum withdrawal amount) of a preferable range of the withdrawal amount H in which preferable ink ejection is achievable, is representable as substantially Hmin=0.16N, regardless of the value of the diameter D, and Hmax indicating an upper limit value (a maximum withdrawal amount) is representable as substantially Hmax=0.555D, regardless of the value of the distance N. Accordingly, from what has been discussed above, it is possible to think that, when the ink withdrawal amount H is within a range where the following conditional formula (2) is satisfied with respect to various combination of the values of the diameter D and those of the distance N, it is possible to achieve preferable ink ejection.

$$0.16N \leq H \leq 0.555D \quad (2)$$

Here, for the purpose of making Hmin common to all the cases where the diameter D is respectively 10 μm, 20 μm, 24 μm, and 30 μm, for the sake of convenience, Hmin is plotted, in all the cases except the case of D=20 μm, based on a consideration that a border between preferable ink ejection and poor ink ejection exists between one circle and one cross which are adjacent to each other on a line of the same value of the distance N (N=20 μm, for example).

Based on the above examination, in the present embodiment, as has been previously described, the drive circuit 60 is configured to generate a driving signal for withdrawing ink from the exit 211*a* of the nozzle 211 to the pressure chamber 231 side, to a position at a distance of 0.16N or more but 0.555D or less from the exit 211*a*, and for causing the ink meniscus to oscillate, during the non-ejection time, during which ink is not ejected, such that the driving element (the piezoelectric element 24) is driven based on this driving signal.

Thus, during the non-ejection time, during which ink is not ejected, by taking into consideration the relationship between the diameter D of the nozzle and the distance N, in other words, by taking into consideration the size of the hole at the exit 211*a* of the nozzle 211 and the position of the circulation flow path part 213, in withdrawing ink by a predetermined amount (equal to or more than 0.16N but equal to or less than 0.555D), it is possible to avoid the degradation of the ink ejection properties (the ink ejection speed). From this, it is possible to say that even in a case where, during the non-ejection time, the ink has failed to be prevented from becoming dry and thus has become more viscous near the exit 211*a* of the nozzle 211, there is a strong possibility that the ink with the increased viscosity has been successfully withdrawn to circulate to be removed from inside the nozzle 211. Furthermore, by circulating ink having increased viscosity, it is made possible to reuse such ink by adjusting its viscosity, and this eliminates the need of a maintenance operation of discharging ink with increased viscosity, such that the amount of waste ink greatly decreases as well.

From behavior of the piezoelectric element 24 based on the driving signal described above, it is possible to say that the ink jet driving method of the present embodiment includes circulating ink via the circulation flow path part 213 during the non-ejection time by withdrawing the ink from the exit 211*a* of the nozzle 211 toward the pressure chamber 231 side, to a position at a distance of 0.16N or more but 0.555D or less from the exit 211*a*, causing an ink meniscus to oscillate, and guiding at least part of the withdrawn ink into the circulation flow path part 213, by means of the piezoelectric element 24.

Here, as illustrated in FIG. 11, the drive circuit 60 may, during the non-ejection time, generate a driving signal that causes the ink meniscus to oscillate a plurality of times, in other words, a driving signal having a plurality of shaking pulses, and feed such a driving signal to the piezoelectric element 24. In this case, during the non-ejection time, the piezoelectric element 24 causes the ink meniscus to oscillate a plurality of times based on the driving signal, and this makes it possible to prevent the ink near the exit 211*a* of the nozzle 211 from becoming dry and more viscous and thus to avoid significant degradation of the ejection properties more securely than in a case where the ink meniscus is caused to oscillate just one time.

Alternatively, the drive circuit 60 may generate a driving signal that causes the ink meniscus to oscillate immediately before ink is ejected as illustrated in FIG. 11, and feed such a driving signal to the piezoelectric element 24. Here, "immediately before ink ejection" means a time period that is before a time point at which an ink ejection pulse is applied and that is shorter than an ejection-pulse application period. By the piezoelectric element 24 causing the ink meniscus to oscillate immediately before ink ejection based on the driving signal, it is made possible to guide and remove the ink with the increased viscosity near the exit 211*a* of the nozzle 211 into the circulation flow path part 213 immediately before ink ejection, meanwhile supplying fresh ink, in other words, ink having an appropriate viscosity, from the pressure chamber 231 into the nozzle 211 such that the ink is ejected during the ejection time. Thereby, it is possible to securely avoid the degradation of the ejection properties.

[Relationship Between Presence/Absence of Circulation and Oscillation and Ejection Speed]

Figure 17:
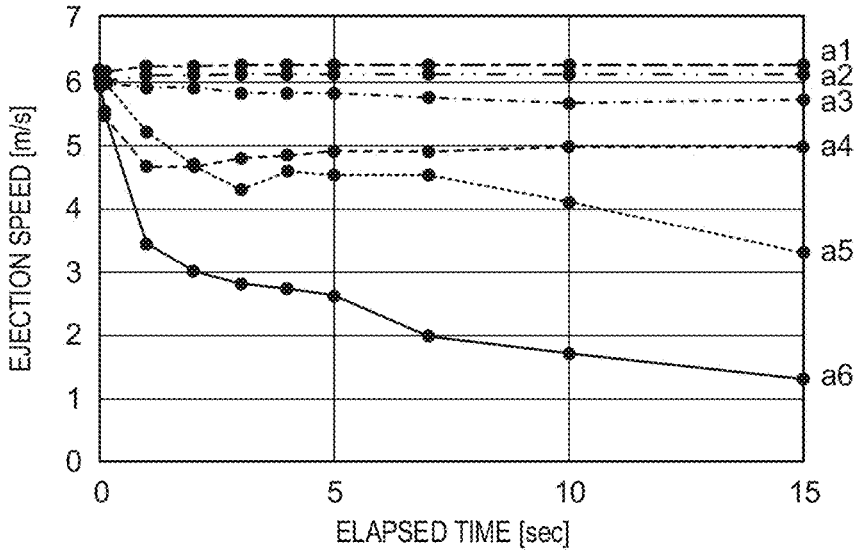
FIG. 17 is a graph showing difference in ejection speed between with and without circulation and oscillation.

Next, results of an examination conducted on the relationship between presence/absence of circulation and oscillation (shaking) and ejection speed will be given below. FIG. 17 shows difference in ejection speed between cases with and without circulation and oscillation (shaking). Note that, in the following description, a circulation amount means an amount of ink that flows in the circulation flow path part 213 per second, and an ejection amount means an amount of ink ejected, during the ejection time, through the nozzle 211 per second (a full ejection amount). For example, when one channel (corresponding to one nozzle) is driven with a driving signal of which the frequency is 50 kHz such that, in a case of ejecting an ink droplet of 3.5 pL in one ejection, the ejection amount at one channel per second will be 0.175 μL (3.5 pL×50 kHz). Although the circulation amount is adjusted by means of the pump 82 (see FIG. 7) in the present embodiment, it goes without saying that the circulation amount may be adjusted further by making use of the difference between water heads.

FIG. 17 shows that, although it is possible to prevent the variation of the ejection speed to some extent (see graph a4) even by merely circulating the ink during the non-ejection time, it is possible to prevent the variation of the ejection speed more effectively by performing shaking (oscillating the ink meniscus) in addition to the circulation (see graphs a1 to a3). FIG. 17 also shows that performing only the shaking without circulating the ink during the non-ejection time has only a small effect of preventing the variation of the ejection speed (see graph a5), and, in a case where neither the shaking nor the circulation of the ink is performed during the non-ejection time, it is impossible to prevent the variation of the ejection speed (see graph a6).

Accordingly, from FIG. 17 as well, it is possible to say that by performing both the shaking (oscillation of the ink meniscus) and the circulation during the non-ejection time, it is made possible to avoid significant reduction of the ejection speed.

Figure 18:
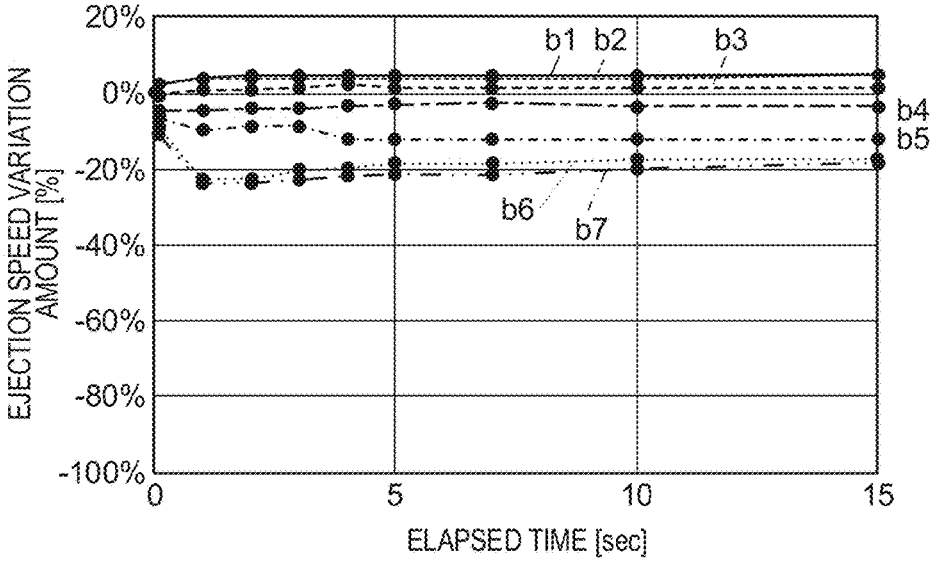
FIG. 18 is a graph showing difference in variation of the ejection speed between cases with different shaking driving potentials, with circulation performed.

Further, FIG. 18 shows difference in variation of the ejection speed between cases with different shaking driving potentials, each under a condition with the circulation performed. In the figure, the amount of variation of the ejection speed, which is represented by the vertical axis, is indicated by the amount of variation (%) of the ejection speed from a reference ejection speed. For example, in a case where the reference ejection speed is 6 m/s and the ejection speed has lowered to 4.8 m/s with time, the amount of variation of the ejection speed is −20%.

From FIG. 18, when the shaking driving potential is 0.05(×31 V) or lower, the lower limit of the variation amount of the ejection speed becomes smaller than −10% (see graphs b5 to b7), but when the shaking driving potential is 0.1(×31 V) or higher, it is possible to restrict the lower limit of the variation amount of the ejection speed to about −5% (see graphs b1 to b4). Accordingly, it is possible to say that, when the shaking driving potential is 0.1(×31 V) or higher, that is, when the ink meniscus withdrawal amount (1.6 μm) corresponding to the above shaking driving potential is equal to or more than 0.08 times the diameter D of the nozzle 211, it is possible to prevent significant reduction of the ejection speed.

Figure 19:
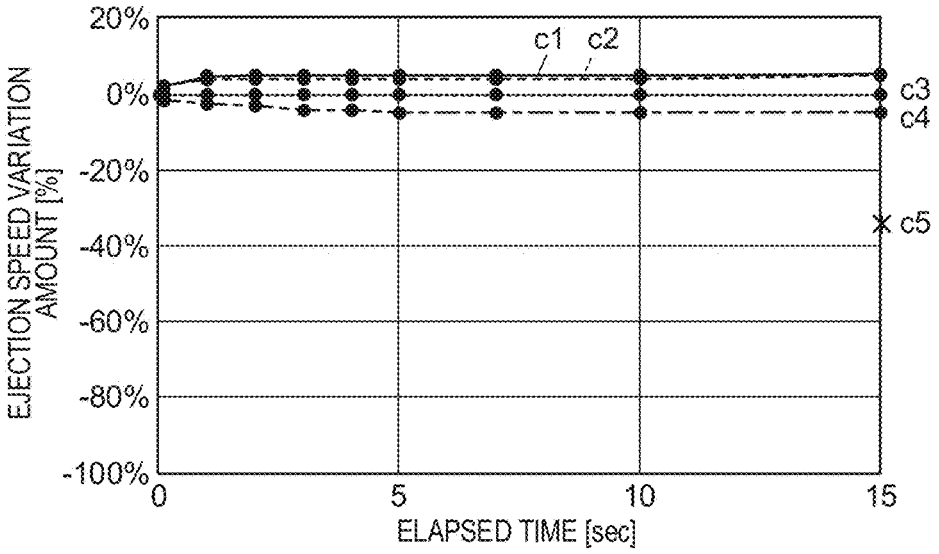
FIG. 19 is a graph showing difference in variation of the ejection speed between cases of different circulation amounts.

FIG. 19 shows difference in variation of the ejection speed between cases with different circulation amounts. Here, the shaking driving potential was 0.3(×31 V), which was common to all the different circulation amounts. It is clear that when the circulation amount is equal to or more than 0.0025 times the ejection amount, it is possible to restrict the lower limit of the variation amount of the ejection speed to about −5% (see graphs c1 to c4), and that, without circulation, the ejection speed is reduced by almost 40% with time (see graph c5). Accordingly, it is possible to say that, from the perspective of avoiding significant reduction of the ejection speed, it is desirable that the circulation amount be equal to or more than 0.0025 times the ejection amount.

It has also become clear that when the circulation amount exceeds 0.01 times the ejection amount, the ejection speed increases (see graphs c1 and c2). It is conceivable that the reason for this increase of the ejection speed is that when the circulation amount during the non-ejection time increases, it becomes easier for air bubbles and the ink with increased viscosity both existing near the nozzle to enter the circulation flow path. On the other hand, it is possible to say that, from the perspective of preventing degradation of ejection efficiency caused when the circulation flow path is enlarged in order to achieve a larger head and a larger circulation amount, it is desirable for the circulation amount to be equal to or less than one time the ejection amount.

It is also clear that, when the circulation amount is equal to 0.025 times the ejection amount, it is possible to restrict the amount of increase of the ejection speed to 5% (see graph c2), but when the circulation amount exceeds 0.025 times the ejection amount, the amount of increase of the ejection speed exceeds 5%, and the ejection properties are significantly degraded (see graph c1). Accordingly, it is possible to say that, from the perspective of securely avoiding significant degradation of the ejection properties (significant increase of the ejection speed), it is desirable for the circulation amount to be equal to or less than 0.025 times the ejection amount.

The above description has dealt with cases where the present embodiment uses the piezoelectric element 24 as a driving element, but there may be used another type of driving element such as a heater element which generates air bubbles inside a pressure chamber, an electrostatic actuator which uses electrostatic force to change the capacity of a pressure chamber, or the like.

[Supplementary Description]

Figure 20:
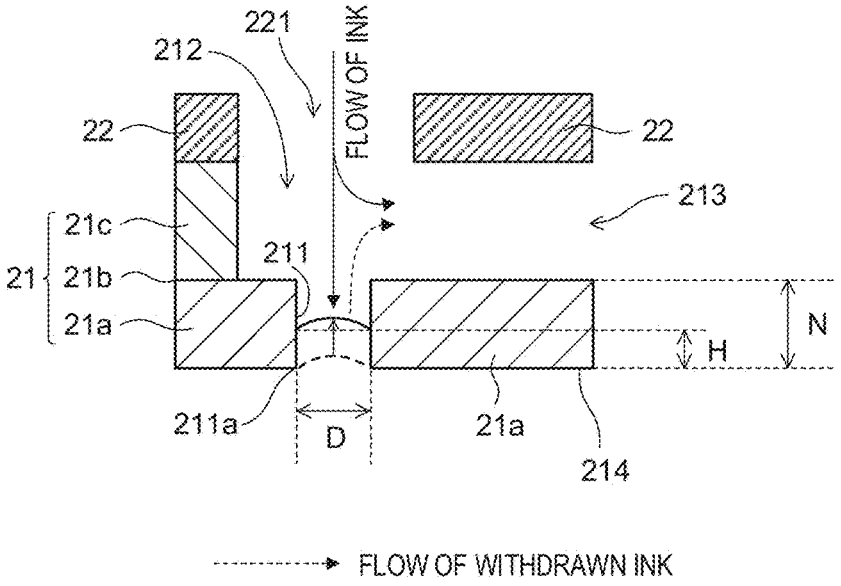
FIG. 20 is an explanatory diagram showing a withdrawal amount by which an end portion of the ink meniscus is withdrawn into the nozzle when the ink is withdrawn.

In FIG. 9, the ink withdrawal amount H (μm) is defined as a distance in the ink ejection direction (the thickness direction of the nozzle plate 21) between the exit 211*a* of the nozzle 211 and a topmost portion of an ink meniscus (in other words, a tip of a concave of the ink meniscus, the tip being most withdrawn into the nozzle 211) in a case where the ink is withdrawn without the edge of the ink meniscus being withdrawn into the nozzle 211 (that is, the edge is located at the exit 211*a* of the nozzle 211). Another case is also expectable where, as illustrated in FIG. 20, the ink is withdrawn into the nozzle 211 with the edge of the ink meniscus also being withdrawn into the nozzle 211, but by considering a feature of the present invention that the tip of the concave of the ink meniscus is withdrawn to be near the circulation flow path part, the same definition of the ink withdrawal amount H is applicable to such a case, too. That is, a configuration and a driving method similar to those of the present embodiment are applicable even to the case where the edge of the ink meniscus is withdrawn into the nozzle 211, by regarding the distance from the exit 211*a* of the nozzle 211 to the topmost portion (the tip of the concave) of the ink meniscus in the ink ejection direction (the thickness direction of the nozzle plate 21) as the ink withdrawal amount H (μm).

Figure 21:
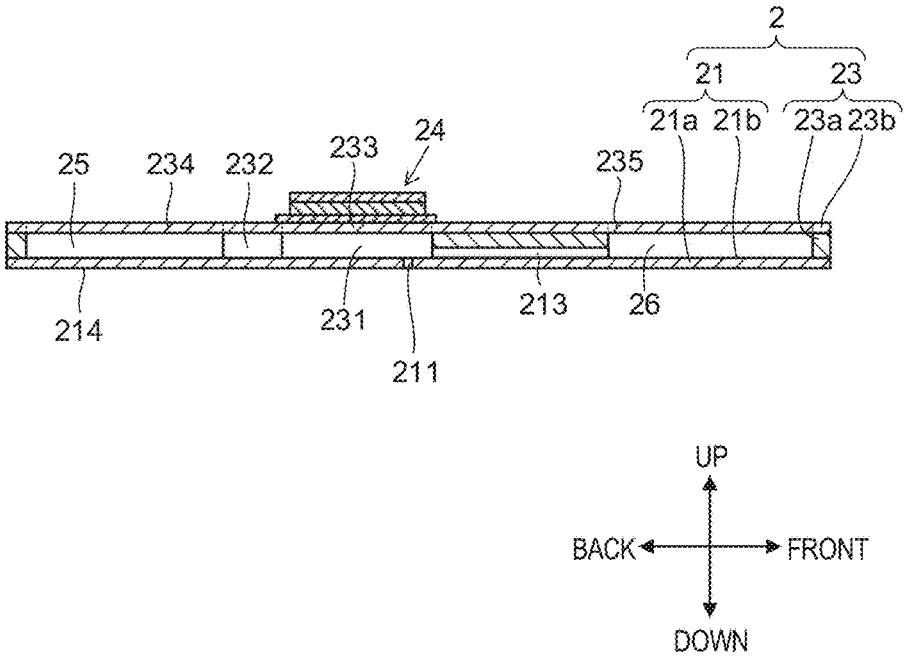
FIG. 21 is a sectional view illustrating another configuration of the head chip of the ink jet head.

Further, FIG. 21 is a sectional view illustrating another configuration of the head chip 2 of the ink jet head 1. The head chip 2 may be configured such that, as illustrated in the figure, the intermediate plate 22 and the nozzle support layer 21*c*, which are illustrated in FIG. 5, are omitted, the circulation flow path part 213 is disposed in the pressure chamber layer 23*a* of the body plate 23, and the body plate 23 and the nozzle plate 21 are directly bonded with each other. In such a configuration, the circulation flow path part 213 directly communicates with the pressure chamber 231, but does not diverge from "the flow path of ink flowing from the pressure chamber 231 toward the nozzle 211". However, if the pressure chamber 231 itself is considered as "the flow path of ink flowing toward the nozzles 211", it is possible to say that the circulation flow path part 213 is disposed so as to diverge from "the flow path of ink flowing toward the nozzle 211". With such a configuration, too, by appropriately setting the ink withdrawal amount H, as in the present embodiment, by taking into consideration the size of the exit 211*a* of the nozzle 211 and the position of the circulation flow path part 213, it is possible to remove ink having increased viscosity from inside the nozzle 211 to thereby avoid the degradation of the ejection properties, which would otherwise be caused by the ink. Further, the various settings and conditions regarding the ink withdrawal amount H described in the present embodiment is applicable also to what is called a shear mode ink jet head, which does not have the intermediate plate 22 or the nozzle support layer 21*c* and ejects ink by means of the shear deformation of a piezoelectric member.

[Others]

With the ink jet driving apparatus and the ink jet driving method of the present embodiment described above, which are also describable as follows, it is possible to achieve the following operational effects.

According to the present embodiment, an ink jet driving apparatus includes a head substrate having a nozzle through which ink is ejects, a pressure chamber which communicates with the nozzle and in which the ink is stored, and a circulation flow path part which diverges from a flow path of the ink flowing toward the nozzle and forms a flow path for circulating ink discharged from the pressure chamber, a driving element which is supported on the head substrate, causes ink in the pressure chamber to be ejected through the nozzle during an ejection time, and causes an ink meniscus in the nozzle to oscillate during a non-ejection time, and a drive controller which controls the driving element. Here, when a diameter of a hole at an exit of the nozzle is represented by D (μm), the exit being a portion of the nozzle that is farthest from the pressure chamber, and a distance, in a direction perpendicular to a surface including the hole at the exit, between the exit and a position in the circulation flow path part that is nearest the exit is represented by N (μm), N≤3.47D is satisfied. During the non-ejection time, the drive controller generates a driving signal for withdrawing ink from the exit of the nozzle toward the pressure chamber side, to a position at a distance of 0.16N or more but 0.555D or less from the exit, and for causing the ink meniscus to oscillate, and the drive controller applies the driving signal to the driving element.

As described above, by taking into consideration the relationship between the distance N and the diameter D, in other words, the relationship between the size of the hole at the exit of the nozzle and the position of the circulation flow path part, in withdrawing ink by a predetermined amount (distance) to cause the ink meniscus to oscillate, it is possible, even in a case where ink near the nozzle exit has failed to be prevented from becoming dry and thus has become more viscous, to increase the possibility of successfully guiding the ink with the increased viscosity into the circulation flow path part to remove the ink from inside the nozzle, even though by a small amount. As a result, it is possible to avoid the degradation of the ejection properties attributable to the ink. Furthermore, when N≤3.47D is satisfied, the position of the circulation flow path part is near the exit of the nozzle, and thus, it becomes easy to withdraw the ink from inside the nozzle and circulate the ink via the circulation flow path part.

According to the present embodiment, an ink jet driving method is a method for driving an ink jet driving apparatus having the following configuration. The ink jet driving apparatus includes a head substrate having a nozzle through which ink is ejected, a pressure chamber which communicates with the nozzle and in which the ink is stored, and a circulation flow path part which diverges from a flow path of the ink flowing toward the nozzle and forms a flow path for circulating ink discharged from the pressure chamber, and a driving element which is supported on the head substrate, causes ink in the pressure chamber to be ejected through the nozzle during an ejection time, and causes an ink meniscus in the nozzle to oscillate during a non-ejection time. When a diameter of a hole at an exit of the nozzle is represented by D (μm), the exit being a portion of the nozzle that is farthest from the pressure chamber, and a distance, in a direction perpendicular to a surface including the hole at the exit, between the exit and a position in the circulation flow path part that is nearest the exit is represented by N (μm), N≤3.47D is satisfied. The driving method includes circulating ink via the circulation flow path part by withdrawing the ink, by means of the driving element, from the exit of the nozzle toward the pressure chamber, to a position at a distance equal to or more than 0.16N but equal to or less than 0.555D from the exit, causing the ink meniscus to oscillate, and guiding at least part of the withdrawn ink into the circulation flow path part.

As described above, by taking into consideration the relationship between the distance N and the diameter D, ink is withdrawn by a predetermined amount (distance), and the ink meniscus is caused to oscillate. Then, by at least partly guiding the withdrawn ink into the circulation flow path part, the ink is circulated via the circulation flow path part. Thereby, even in a case where the ink has failed to be prevented from becoming dry and thus has become more viscous near the exit of the nozzle, it is possible to increase the possibility of successfully guiding the ink with the increased viscosity into the circulation flow path part to remove the ink from inside the nozzle, even though by a small amount. As a result, it is possible to avoid the degradation of the ejection properties attributable to the ink. Furthermore, when N≤3.47D is satisfied, the position of the circulation flow path part is near the nozzle exit, and thus, it becomes easy to withdraw the ink existing inside the nozzle and circulate the ink via the circulation flow path part.

In the driving apparatus and the driving method described above, it is desirable that the amount of ink that flows in the circulation flow path part per second during the non-ejection time be equal to or more than 0.0025 times the amount of ink that is ejected through the nozzle per second during the ejection time.

When the circulation amount during the non-ejection time is equal to or more than 0.0025 times the ejection amount during the ejection time, by guiding the ink, which has become more viscous near the exit of the nozzle, into the circulation flow path part to circulate therein, it is possible to almost completely remove the ink from inside the nozzle. Thereby, it is possible to securely avoid significant degradation of the ejection properties. For example, it is possible to restrict the amount of reduction of the ejection speed to 5% of the reference speed at the maximum.

In the driving apparatus and the driving method described above, it is desirable that the amount of ink that flows in the circulation flow path part per second during the non-ejection time be equal to or less than one time the amount of ink ejected through the nozzle per second during the ejection time.

In order to achieve a circulation amount during the non-ejection time that exceeds one time the ejection amount during the ejection time, it is necessary to enlarge the circulation flow path part, which will make it difficult to arrange nozzles highly densely. With the circulation amount that is equal to or less than one time the ejection amount, it is possible to avoid significant degradation of the ejection properties while simultaneously achieving a high-density arrangement of nozzles easily.

In the driving apparatus and the driving method described above, it is desirable that the amount of ink that flows in the circulation flow path part per second during the non-ejection time be equal to or less than 0.025 times the amount of ink ejected through the nozzle per second during the ejection time.

With the circulation amount during the non-ejection time that is equal to or less than 0.025 times the ejection amount during the ejection time, it is possible to restrict the variation of the ejection properties caused by the circulation as much as possible, and securely avoid the degradation of the ejection properties.

In the driving apparatus described above, it is desirable that, during the non-ejection time, the drive controller generate a driving signal for oscillating the ink meniscus a plurality of times, and feed the driving signal to the driving element. In the driving method described above, it is desirable that, during the circulating of the ink, during the non-ejection time, the ink meniscus be caused to oscillate a plurality of times.

By the driving element causing an ink meniscus to oscillate a plurality of times during the non-ejection time based on the driving signal described above, it is possible to securely prevent ink near the exit of the nozzle from becoming dry and prevent increase in viscosity of the ink itself during the non-ejection time, and thus to securely avoid significant degradation of the ejection properties.

In the driving apparatus described above, it is desirable that the drive controller generate a driving signal for oscillating the ink meniscus immediately before ink is ejected, and feed the driving signal to the driving element. In the driving method described above, it is desirable that, during the circulating of the ink, the ink meniscus be caused to oscillate immediately before ink is ejected.

By the driving element causing an ink meniscus to oscillate based on the driving signal immediately before ink is ejected, it is possible, immediately before ink is ejected, to guide the ink with increased viscosity near the exit of the nozzle into the circulation flow path part to remove the ink from inside the nozzle, while supplying fresh ink (with a predetermined viscosity) from the pressure chamber into the nozzle, and have the ink ejected during the ejection time. Thereby, it is possible to securely avoid the degradation of the ejection properties.

In the driving apparatus and the driving method, the circulation flow path part may be disposed to diverge from a flow path of the ink flowing from the pressure chamber toward the nozzle. In this case, it is possible to form the circulation flow path part by making use of a space in an ink flow direction from the pressure chamber to the nozzle (that is, for example, the thickness direction of the head substrate), and thus it becomes easy to increase the capacity of the circulation flow path part (a circulation flow path).

In the driving apparatus and the driving method, it is preferable that $N \leq 3.00D$ is satisfied. In this case, the position of the circulation flow path part is even closer to the exit of the nozzle, and this makes it easy to control the ink withdrawal amount such that the ink withdrawal amount is equal to or more than 0.16N but equal to or less than 0.555D.

In the driving apparatus and the driving method described above, it is desirable that $N \leq 2.00D$ be satisfied. In this case, the position of the circulation flow path part is much closer to the exit of the nozzle, and this makes it easier to control the ink withdrawal amount such that the ink withdrawal amount is equal to or more than 0.16N but equal to or less than 0.555D.

In the driving apparatus and the driving method described above, it is desirable that, during the non-ejection time, ink circulation (caused by the pump) and ink meniscus oscillation (withdrawal of ink from the nozzle) (caused by the driving element) be performed simultaneously (see graphs a1 to a3 of FIG. 17). In this case, it is possible to avoid significant degradation of the ejection speed which would otherwise be caused by increased ink viscosity.

Although embodiments of the present invention have been described and illustrated in detail, it is clearly understood that the same is by way of illustration and example only and not limitation, the scope of the present invention should be interpreted by terms of the appended claims.

INDUSTRIAL APPLICABILITY

The ink jet driving apparatus and driving method of the present invention are usable in ink jet heads and ink jet printers.

LIST OF REFERENCE SIGNS

1 ink jet head (ink jet driving apparatus)
2 head chip (head substrate)
24 piezoelectric element (driving element)
60 drive circuit (drive controller)
100 ink jet printer (ink jet driving apparatus)
211 nozzle
211*a* exit
213 circulation flow path part
231 pressure chamber
D diameter
N distance

The invention claimed is:

1. An ink jet driving apparatus comprising:

a head substrate which includes
- a nozzle through which ink is ejected,
- a pressure chamber which communicates with the nozzle and in which the ink is stored, and
- a circulation flow path part which is disposed diverging from a flow path of the ink flowing toward the nozzle, and which forms a flow path for circulating ink discharged from the pressure chamber, a driving element which is supported on the head substrate, and which causes ink inside the pressure chamber to be ejected through the nozzle during an ejection time and causes an ink meniscus inside the nozzle to oscillate during a non-ejection time; and a drive controller which controls the driving element, wherein when
- a diameter of a hole at an exit of the nozzle is represented by D (μm), the exit being a portion of the nozzle that is farthest from the pressure chamber, and
- a distance, in a direction perpendicular to a surface including the hole at the exit, between the exit and a position in the circulation flow path part that is nearest the exit is represented by N (μm), $N \leq 3.47D$ is satisfied, and the drive controller generates a driving signal for withdrawing ink from the exit of the nozzle toward the pressure chamber, to a position at a distance equal to or more than 0.16N but equal to or less than 0.555D from the exit, and for causing the ink meniscus to oscillate, and the drive controller applies the driving signal to the driving element.

2. The ink jet driving apparatus according to claim 1, wherein an amount of ink that flows in the circulation flow path part per second during the non-ejection time is equal to or more than 0.0025 times an amount of ink that is ejected through the nozzle per second during the ejection time.

3. The ink jet driving apparatus according to claim 2, wherein the amount of ink that flows in the circulation flow path part per second during the non-ejection time is equal to or less than one time the amount of ink that is ejected through the nozzle per second during the ejection time.

4. The ink jet driving apparatus according to claim 2, wherein the amount of ink that flows in the circulation flow path part per second during the non-ejection time is equal to or less than 0.025 times the amount of ink that is ejected through the nozzle per second during the ejection time.

5. The ink jet driving apparatus according to claim 1, wherein the drive controller generates a driving signal for causing the ink meniscus to oscillate a plurality of times during the non-ejection time, and the drive controller feeds the driving signal to the driving element.

6. The ink jet driving apparatus according claim 1, wherein the drive controller generates a driving signal for causing the ink meniscus to oscillate immediately before ink is ejected, and the drive controller feeds the driving signal to the driving element.

7. The ink jet driving apparatus according to claim 1, wherein the circulation flow path part is disposed diverging from a flow path of the ink flowing from the pressure chamber toward the nozzle.

8. The ink jet driving apparatus according to claim 1, wherein $N \leq 3.00D$ is satisfied.

9. The ink jet driving apparatus according to claim 1, wherein $N \leq 2.00D$ is satisfied.

10. An ink jet driving method for driving an ink jet driving apparatus, the ink jet driving apparatus including a head substrate including a nozzle through which ink is ejected, a pressure chamber which communicates with the nozzle and in which the ink is stored, and a circulation flow path part which diverges from a flow path of the ink flowing toward the nozzle, and which forms a flow path for circulating ink discharged from the pressure chamber, and a driving element which is supported on the head substrate, and which causes ink inside the pressure chamber to be ejected through the nozzle during an ejection time and causes an ink meniscus inside the nozzle to oscillate during a non-ejection time, when a diameter of a hole at an exit of the nozzle is represented by D (μm), the exit being a portion of the nozzle that is farthest from the pressure chamber, and a distance, in a direction perpendicular to a surface including the hole at the exit, between the exit and a position in the circulation flow path part that is nearest the exit is represented by N (μm), $N \leq 3.47D$ being satisfied, the driving method comprising circulating ink via the circulation flow path part during the non-ejection time by withdrawing the ink from the exit of the nozzle toward the pressure chamber, to a position at a distance equal to or more than 0.16N but equal to or less than 0.555D from the exit, causing the ink meniscus to oscillate, and guiding at least part of withdrawn ink into the circulation flow path part, by means of the driving element.

11. The ink jet driving method according to claim 10, wherein an amount of ink that flows in the circulation flow path part per second during the non-ejection time is equal to or more than 0.0025 times an amount of ink that is ejected through the nozzle per second during the ejection time.

12. The ink jet driving method according to claim 11, wherein the amount of ink that flows in the circulation flow path part per second during the non-ejection time is equal to or less than one time the amount of ink that is ejected through the nozzle per second during the ejection time.

13. The ink jet driving method according to claim 11, wherein the amount of ink that flows in the circulation flow path part per second during the non-ejection time is equal to or less than 0.025 times the amount of ink that is ejected through the nozzle per second during the ejection time.

14. The ink jet driving method according to claim 10, wherein, during the circulating of the ink, the ink meniscus is caused to oscillate a plurality of times during the non-ejection time.

15. The ink jet driving method according to claim 10, wherein, during the circulating of the ink, the ink meniscus is caused to oscillate immediately before ink is ejected.

* * * * *